US009745975B2

(12) United States Patent
Dancek

(10) Patent No.: US 9,745,975 B2
(45) Date of Patent: Aug. 29, 2017

(54) METHOD FOR CONTROLLING AN ARTIFICIAL LIFTING SYSTEM AND AN ARTIFICIAL LIFTING SYSTEM EMPLOYING SAME

(71) Applicant: Tundra Process Solutions Ltd., Calgary (CA)

(72) Inventor: Kevin Dancek, Cochrane (CA)

(73) Assignee: Tundra Process Solutions Ltd., Calgary (CA)

( * ) Notice: Subject to any disclaimer, the term of this patent is extended or adjusted under 35 U.S.C. 154(b) by 567 days.

(21) Appl. No.: 14/246,779

(22) Filed: Apr. 7, 2014

(65) Prior Publication Data

US 2015/0285041 A1 Oct. 8, 2015

(51) Int. Cl.

| | |
|---|---|
| ***F04B 49/06*** | (2006.01) |
| ***E21B 43/12*** | (2006.01) |
| ***F04B 49/20*** | (2006.01) |
| ***F04B 47/04*** | (2006.01) |

(52) U.S. Cl.

CPC ..... *F04B 49/065* (2013.01); *E21B 43/126* (2013.01); *F04B 47/04* (2013.01); *F04B 49/20* (2013.01); *F04B 2201/0201* (2013.01); *F04B 2201/121* (2013.01)

(58) Field of Classification Search

CPC ..... F04B 47/02; F04B 47/04; F04B 47/06; F04B 47/14; F04B 47/145; F04B 49/002; F04B 49/06; F04B 49/065; F04B 49/12; F04B 49/20; F04B 2201/0201;

(Continued)

(56) References Cited

U.S. PATENT DOCUMENTS

| | | | |
|---|---|---|---|
| 2,668,517 | A | 2/1954 | Craft |
| 4,414,808 | A | 11/1983 | Benson |
| 4,691,511 | A | 9/1987 | Dollison |

(Continued)

FOREIGN PATENT DOCUMENTS

| | | |
|---|---|---|
| CA | 2414646 | 1/1947 |
| EP | 1355169 B1 | 2/2010 |

OTHER PUBLICATIONS

"Hydraulic pumping," PetroWiki, published in http://petrowiki.org/Hydraulic_pumping.

"Chemical Injection Systems," Frames Group, published in http://www.frames-group.com/getattachment/5a11b2b8-eea5-406f-9f7b-cb3ec177213d/Chemical-Injection-pl-web.pdf.aspx?ext=.pdf.

"Overview of Artificial Lift Systems," by Kermit E. Brown, published in the Journal of Petroleum Technology, Oct. 1982.

"Downhole Chemical Injection Lines—Why Do They Fail? Experiences, Challenges and Application of New Test Methods," by Britt Marie Hustad et al., published in Society of Petroleum Engineers (SPE) 154967, 2012, found in https://www.onepetro.org/download/conference-paper/SPE-154967-MS?id=conference-paper%2FSPE-154967-MS.

(Continued)

*Primary Examiner* — Theodore Stigell
*Assistant Examiner* — Chirag Jariwala
(74) *Attorney, Agent, or Firm* — Parlee McLaws LLP (CGY); Sean Goodwin

(57) ABSTRACT

An artificial lifting system is disclosed. The artificial lifting system comprises an elongated cylinder fixed to a base or ground. The elongated cylinder receives a piston rod axially movable therein. The piston rod engages a downhole rod pump for driving the rod pump reciprocating uphole and downhole to pump downhole fluid to the surface. A control unit controls the axial movement of the piston rod, and automatically adjust the system operation to adapt to drift of the top and bottom stop positions of the piston rod. In an alternative embodiment, the system further comprises a dump valve controlled by the control unit to prevent overstroke. In another embodiment, the system further comprises a chemical injection unit for injecting treatment fluid to a wellbore under the control of the control unit.

28 Claims, 18 Drawing Sheets

(58) Field of Classification Search
CPC ..... F04B 2201/0202; F04B 2201/0203; F04B 2201/0206; F04B 2201/121; E21B 43/126
USPC ..... 417/46; 700/13, 302; 60/376, 377
See application file for complete search history.

(56) References Cited

U.S. PATENT DOCUMENTS

| | | | | |
|---|---|---|---|---|
| 4,761,120 | A | 8/1988 | Mayer et al. | |
| 4,801,126 | A | 1/1989 | Rosman | |
| 5,117,913 | A | 6/1992 | Themig | |
| 5,281,100 | A * | 1/1994 | Diederich | E21B 43/127 417/18 |
| 5,996,688 | A | 12/1999 | Schultz et al. | |
| 6,599,095 | B1 | 7/2003 | Takada et al. | |
| 6,880,639 | B2 | 4/2005 | Rhodes et al. | |
| 6,981,553 | B2 | 1/2006 | Stegemeier et al. | |
| 7,373,971 | B2 | 5/2008 | Montgomery | |
| 7,762,321 | B2 | 7/2010 | Fesi et al. | |
| 8,083,499 | B1 | 12/2011 | Krug et al. | |
| 8,106,615 | B2 | 1/2012 | Tsuruta et al. | |
| 8,235,107 | B2 | 8/2012 | Fesi et al. | |
| 8,267,378 | B1 | 9/2012 | Rosman | |
| 8,336,613 | B2 | 12/2012 | Ramsey et al. | |
| 8,408,314 | B2 | 4/2013 | Patel et al. | |
| 8,430,162 | B2 | 4/2013 | Kotsonis et al. | |
| 8,534,353 | B2 | 9/2013 | Groves | |
| 8,562,308 | B1 | 10/2013 | Krug et al. | |
| 8,851,860 | B1 * | 10/2014 | Mail | F04B 47/02 166/105 |
| 8,944,157 | B2 * | 2/2015 | Mail | B66B 9/04 166/383 |
| 2004/0014607 | A1 | 1/2004 | Sinclair et al. | |
| 2004/0043501 | A1 | 3/2004 | Means et al. | |
| 2006/0171821 | A1 | 8/2006 | Brown | |
| 2009/0194291 | A1 | 8/2009 | Fesi et al. | |
| 2010/0054959 | A1 | 3/2010 | Rogers et al. | |
| 2010/0116508 | A1 | 5/2010 | Oglesby | |
| 2011/0067511 | A1 * | 3/2011 | Pettersson | F16H 25/2015 74/89.28 |
| 2013/0048307 | A1 | 2/2013 | Patel | |
| 2014/0234122 | A1 * | 8/2014 | Donohoe | F04B 23/04 417/53 |

OTHER PUBLICATIONS

"Downhole Chemical Injection Through Gas Lift Lines: Options and Consequences," by M.A. Daas et al., published in SPE 142951, 2011, found in https://www.onepetro.org/download/conference-paper/SPE-142951-MS?id=conference-paper%2FSPE-142951-MS.
"Development and Application of a Downhole Chemical Injection Pump for Use in ESP Applications," R.W. Cramer et al., published in SPE 14403, 1985, found in https://www.onepetro.org/download/conference-paper/SPE-14403-MS?id=conference-paper%2FSPE-14403-MS.
"Unique Hydraulic Lift System," by C. Allen Bell et al., published in SPE 4539, 1973, found in https://www.onepetro.org/conference-paper/SPE-4539-MS.
"Chemical Injection System Overview," published in http://www.weatherford.com/Products/Production/InjectionSystems/Chem.Inj.Overview/, captured on Mar. 12, 2014.
"Artificial-Lift Systems: Pump up reservoir recovery with the experts in all forms of lift," published in Brochure 746.06, Weatherford, 2010.
"Products Serving the Oil & Gas Industry," published in SPXFT-005, SPX Corporation, Aug. 2012.
"Chemical Injection for Oil & Gas," published in BL-1649, SPX Corporation, Aug. 2008.
"Chapter 14—PEH:Hydraulic Pumping in Oil Wells," James Fretwell, Weatherford Artificial Lift Systems, as found in Petroleum Engineering Handbook:Vol. IV—Production Operations Engineering, Joe Dunn Clegg, Editor, Society of Petroleum Engineers, 2006-ISBN 978-1-55563-118-5, pp. 41-103. http://petrowiki.org/PEH%3AHydraulic_Pumping_in_Oil_Wells.
"Artificial Lift" Stuart L. Scott, published in the Journal of Petroleum Technology, May 2006, pp. 58-67.
Oil & Gas Industry—Produced Water Chemical Treatment 101, Hayward Gordon Ltd., published in http://haywardgordon.com/wp-content/themes/HG2014/pdfs/PRODUCED_WATER_CHEMICAL_TREATMENT_101.pdf, 6pg.

* cited by examiner

METHOD FOR CONTROLLING AN ARTIFICIAL LIFTING SYSTEM AND AN ARTIFICIAL LIFTING SYSTEM EMPLOYING SAME

FIELD

The present invention relates generally to an artificial lifting system, and in particular to a method for automatically controlling an artificial lifting system to ensure its operation within a defined range of stroke and an artificial lifting system employing the same.

BACKGROUND

Artificial lifting systems for pumping downhole fluids such as crude oil or water, from a production well to the surface have been widely used in oil and gas industry. Existing artificial lifting systems include rod pumps, Electric Submersible Pumps (ESPs), Gas lift systems, Progressing Cavity Pumps (PCPs) and Hydraulic pumps.

Rod pumps generally comprises a sucker rod connecting to a subsurface pump, and a driver system coupled to the sucker rod for driving the sucker rod in a reciprocating motion for pumping downhole fluids to the surface. For example, traditional pumpjacks or horsehead pumps comprise a prime mover such as an electric motor or gas engine, which drives a set of gears to reduce the speed. The gears drive a pair of cranks, and the cranks in turn raise and lower one end of a beam having a "horse head" on the other end thereof. A steel cable, i.e., a bridle, connects the horse head to a downhole pump via a polished rod and sucker rods. The reciprocating up and down movement of the horse head then drives the downhole pump reciprocating between a fully retracted position and a fully extended position to pump the downhole fluid to the surface. The distance between the fully retracted position and the fully extended position is called a stroke. Generally, a stroke maybe a down-stroke that resets the rod pump downhole to the fully retracted position, or an up-stroke that moves the rod pump uphole to the fully extended position for pumping fluid to the surface.

Generally, long-strokes are preferable because, comparing to a rod pump with shorter pump stroke, a rod pump with longer pump stroke requires slower pumping speed for a given production rate, and therefore results in lower rod string stress and reduced power consumption.

The Sure Stroke Intelligent™ Lift System offered by Tundra Process solutions of Calgary, Alberta, Canada, the assignee of the subject patent application, uses a vertical hydraulic cylinder to drive a polished rod moving axially up and down, which in turn drives the downhole pump via sucker rods to pump downhole fluid to the surface with long strokes, e.g., ranging from 168 inches to 360 inches based on models.

U.S. Pat. No. 8,562,308, entitled "Regenerative Hydraulic Lift System", to Krug, et al., discloses a hydraulic cylinder assembly for a fluid pump including a cylinder, a bearing attached to a about a first end of the cylinder, a rod slideably mounted within the bearing, and a piston located about an end of the rod in the cylinder opposite the bearing. A central axis of the rod is offset from, and parallel to, a centerline of the cylinder to impede a rotation of the piston about the rod. The hydraulic cylinder assembly further includes a hydraulic motor fluidly connected to the cylinder, the pump configured to provide a hydraulic pressure to the cylinder during an up-stroke of the piston and rod and the pump further configured to generate electricity on the down-stroke of the piston and rod.

U.S. Pat. No. 8,267,378, entitled "Triple Cylinder with Auxiliary Gas over Oil Accumulator", to Rosman, discloses a hydraulic lift system for artificial lift pumping or industrial hoisting comprising a three chamber cylinder, a gas-over-oil accumulator, a large structural gas accumulator and a large flow pilot operated check valve. A matrix variable frequency drive, a standard variable frequency drive, an electrical squirrel cage motor or a natural gas engines are part of the main prime mover alternatives.

In above systems, a movable rod or plunger moves axially in a vertically oriented cylinder to drive the downhole rod pump for pumping fluid to the surface with long strokes. The stroke, however, may drift in operation due to change of environmental factors, such as change of temperature, downhole pump load, and the like. Large safety margins are usually applied to a top and bottom limit to such a stroke to avoid damage the cylinder and wellhead. Safety margins result in reduced stroke and reduced pumping effectiveness. Moreover, operators are thus required to regularly check the travel of the plunger, and reset top and bottom safety margins, causing burden to operators.

It is therefore an object to provide a novel method of automatically controlling an artificial lifting system to ensure its operation within a defined stroke range and an artificial lifting system employing same.

SUMMARY

According to one aspect of this disclosure, there is provided a lifting system for lifting downhole fluid from a downhole rod pump in a wellbore to surface, comprising: a linear actuator comprising a movable component moveable between a first and a second limit and driveably coupled to the downhole rod pump; a power unit coupled to said linear actuator for driving said movable component to reciprocate; the reciprocating of said movable component driving said downhole rod pump to pump downhole fluid to the surface; a sensor for detecting the position of said movable component; and a control unit coupled to said sensor and said power unit for controlling the power unit for reciprocating said movable component between a first target stop position and a second target stop position, for moving said movable component uphole to stop at about said first target stop position, and for moving said movable component downhole to stop at about said second target stop position; determining, based on the position information received from said sensor, a first actual stop position and a second actual stop position; determining a first drift being the difference between the first actual stop position and the first target stop position, and a second drift being the difference between the second actual stop position and the second target stop position; and at the control unit, automatically controlling the operation of the power unit to minimize the first and second drifts.

According to another aspect of this disclosure, said control unit stores a predefined first deceleration position at which deceleration of the said movable component commences during the movement thereof towards said first target stop position, and stores a predefined second deceleration position at which deceleration of said movable component is commenced during the movement thereof towards said second target stop position; and wherein said automatically adjusting the operation of the power unit comprises: adjusting the position of the first deceleration position based on the first drift; adjusting the position of the second deceleration position based on the second drift; and adjusting the operation of the power unit to decelerate said movable component at the adjusted first deceleration position during the movement thereof towards said first target stop position, and to decelerate said movable component at the adjusted second deceleration position during the movement thereof towards said second target stop position.

According to another aspect of this disclosure, the adjusted first deceleration position is the difference between said predefined first deceleration position and said first drift, and said adjusted second deceleration position is the difference between said predefined second deceleration position and said second drift.

According to another aspect of this disclosure, the linear actuator comprises: a hollow cylinder receiving a piston rod axially movable therein; and at least a first chamber for receiving a power medium; the intake of the power medium into said first chamber driving said piston rod moving towards the first stop position.

According to another aspect of this disclosure, the power medium is a power fluid; and wherein said power unit is a hydraulic power unit comprising a hydraulic motor and a power fluid reservoir storing said power fluid, said hydraulic motor sending said power fluid, via a set of conduits, into and out of said first chamber for driving said piston rod to reciprocate in said cylinder.

According to another aspect of this disclosure, said a set of conduits comprises a conduit branch connected to said power fluid reservoir via a normally-closed valve, and said control unit is further controllably coupled to said valve for determining whether the position of said piston rod, during the movement towards said first target stop position, is beyond a first limit, said first limit is further from said first target stop position along the direction of said movement towards said first target stop position; and opening said valve for flowing the power fluid in said a set of conduits into said power fluid reservoir via said conduit branch and said valve.

According to another aspect of this disclosure, the control unit of the lifting system further controls said power unit to initialize the operation of the lifting system through a first initialization stage by: determining an initial first stop position and an initial second stop position about the mid-point of the target top and bottom stop positions, the distance between the initial first stop position and the initial second stop position is a predefined percentage of the distance between the first and second target stop positions; and moving the movable component to one of the initial first and second stop positions to reciprocate the movable component for at least one reciprocating cycle, wherein in each of said at least one reciprocating cycle in the first initialization stage, said control unit controls said power unit to expand the first and second stop positions toward the first and second target stop positions, respectively, by a first expansion step value.

According to another aspect of this disclosure, during said first initialization stage, said control unit controls said power unit to reciprocate the movable component until the distance between the first and second stop positions and the first and second target stop positions, respectively, is smaller than said first expansion step value.

According to another aspect of this disclosure, said control unit further controls said power unit to initialize the operation of the lifting system through a second initialization stage by: reciprocating the movable component for at least one reciprocating cycle, wherein in each of said at least one reciprocating cycle in the second initialization stage, said control unit controls said power unit to expand the first and second stop positions toward the first and second target stop positions, respectively, by a second expansion step value.

According to another aspect of this disclosure, said first and second expansion step values are second predefined values.

According to another aspect of this disclosure, during said second initialization stage, said control unit controls said power unit to reciprocate the movable component until the distance between the first and second stop positions and the first and second target stop positions, respectively, is smaller than said second expansion step value.

According to another aspect of this disclosure, said control unit controls said power unit to move the movable component towards the first target stop position at a first speed and to move the movable component towards the second target stop position at a second speed; and wherein said control unit receives a command from an operator indicating the change of at least one of the first and the second speeds, and in response to said command, re-initializes the operation of the lifting system by: determining an initial first stop position if the first speed is changed, said initial first stop position being intermediate to the first and second target stop positions with a distance to the first target stop position of $(1-C_1)S_N/2$, wherein $S_N$ is the distance between the first and second target stop positions and $C_1$ is a predefined percentage; determining an initial second stop position if the second speed is changed, said initial second stop position being intermediate to the first and second target stop positions with a distance to the second target stop position of $(1-C_1)S_N/2$; determining at least a first expansion step value; determining at least a first number p of reciprocating cycles corresponding to said first expansion step value; and reciprocating the movable component for p reciprocating cycles, wherein in the first cycle of the p reciprocating cycles, said control unit controls said power unit to move the movable component to the initial first stop position if the first speed is changed; move the movable component to the initial second stop position if the second speed is changed; and in the next (p−1) reciprocating cycles, said control unit controls said power unit to expand the first stop position toward the first target stop position by the first expansion step value if the first speed is changed; and expand the second stop position toward the second target stop position by the first expansion step value if the second speed is changed.

According to another aspect of this disclosure, said control unit re-initializes the operation of the lifting system by further: determining a second expansion step value; determining a second number q of reciprocating cycles corresponding to said second expansion step value; and after said p reciprocating cycles are completed, reciprocating the movable component for q reciprocating cycles, wherein in each of the q reciprocating cycles, said control unit controls said power unit to expand the first stop position toward the first target stop position by the first expansion step value if the first speed is changed; and expand the second stop position toward the second target stop position by the first expansion step value if the second speed is changed.

According to another aspect of this disclosure, the lifting system further comprises a chemical injection assembly coupled to said control unit and the wellbore; wherein said control unit enables said chemical injection assembly when said lifting system is in operation, and disables said chemical injection assembly when the operation of said lifting system is stopped.

According to another aspect of this disclosure, there is provided a method for lifting downhole fluid from a reciprocating downhole fluid lifting device to surface, comprising: setting up a first and a second target stop position; reciprocating a movable component of a linear actuator between said first and second target stop positions for driving the downhole fluid lifting device; determining a first actual stop position corresponding to said first target stop position and a second actual stop position corresponding to said second target stop position; determining a first drift being the difference between the first actual stop position and the first target stop position, and a second drift being the difference between the second actual stop position and the second target stop position; and automatically adjusting the reciprocating of the movable component to minimize for the first and second drifts.

According to another aspect of this disclosure, said automatically adjusting the reciprocating of the movable component comprises: determining a first deceleration position based on the first drift; determining a second deceleration position based on the second drift; and decelerating said movable component at the first deceleration position during the movement thereof towards said first target stop position, and decelerating said movable component at the second deceleration position during the movement thereof towards said second target stop position.

According to another aspect of this disclosure, said determining a first deceleration position comprises: calculating the first deceleration position as the difference between a predefined first deceleration position and said first drift; and calculating the second deceleration position as the difference between a predefined second deceleration position and said second drift.

According to another aspect of this disclosure, said reciprocating a movable component of a linear actuator comprises: sending a power fluid into a chamber coupled to said movable component to move the movable component towards the first target stop position.

According to another aspect of this disclosure, said reciprocating a movable component of a linear actuator further comprises: determining whether the position of said movable component, during the movement towards said first target stop position, is beyond a first limit, said first limit being further from said first target stop position along the direction of said movement towards said first target stop position; and preventing the power fluid from entering into said chamber.

According to another aspect of this disclosure, the method further comprising an initialization process, comprising: determining an initial first stop position and an initial second stop position about the mid-point of the target top and bottom stop positions, the distance between the initial first stop position and the initial second stop position is a predefined percentage of the distance between the first and second target stop positions; moving the movable component to one of the initial first and second stop positions to reciprocate the movable component for n reciprocating cycle(s), wherein n≥1, and in each of the n reciprocating cycle(s), said control unit controls said power unit to expand the first and second stop positions toward the first and second target stop positions, respectively, by the first expansion step value; and when the distance between the first and second stop positions and the first and second target stop positions, respectively, is smaller than said first expansion step value, reciprocating the movable component for m reciprocating cycle(s), wherein m≥1, and in each of the m reciprocating cycle(s), said control unit controls said power unit to expand the first and second stop positions toward the first and second target stop positions, respectively, by a second expansion step value.

BRIEF DESCRIPTION OF THE DRAWINGS

FIG. 1D shows an enlarged portion P1 of FIG. 1C on the left hand side of line I-I wherein connectors A to F are connected to the corresponding connectors A to F of FIG. 1E;

FIG. 1E shows an enlarged portion P2 of FIG. 1C between lines I-I and II-II wherein connectors A to F are connected from the corresponding connectors A to F of FIG. 1D, and connectors G, H, J, K and L are connected to the corresponding connectors G, H, J, K and L of FIG. 1F;

FIG. 1F shows an enlarged portion P3 of FIG. 1C on the right hand side of line II-II wherein connectors G, H, J, K and L are connected from the corresponding connectors G, H, J, K and L of FIG. 1E;

DETAILED DESCRIPTION

Figure 1A:
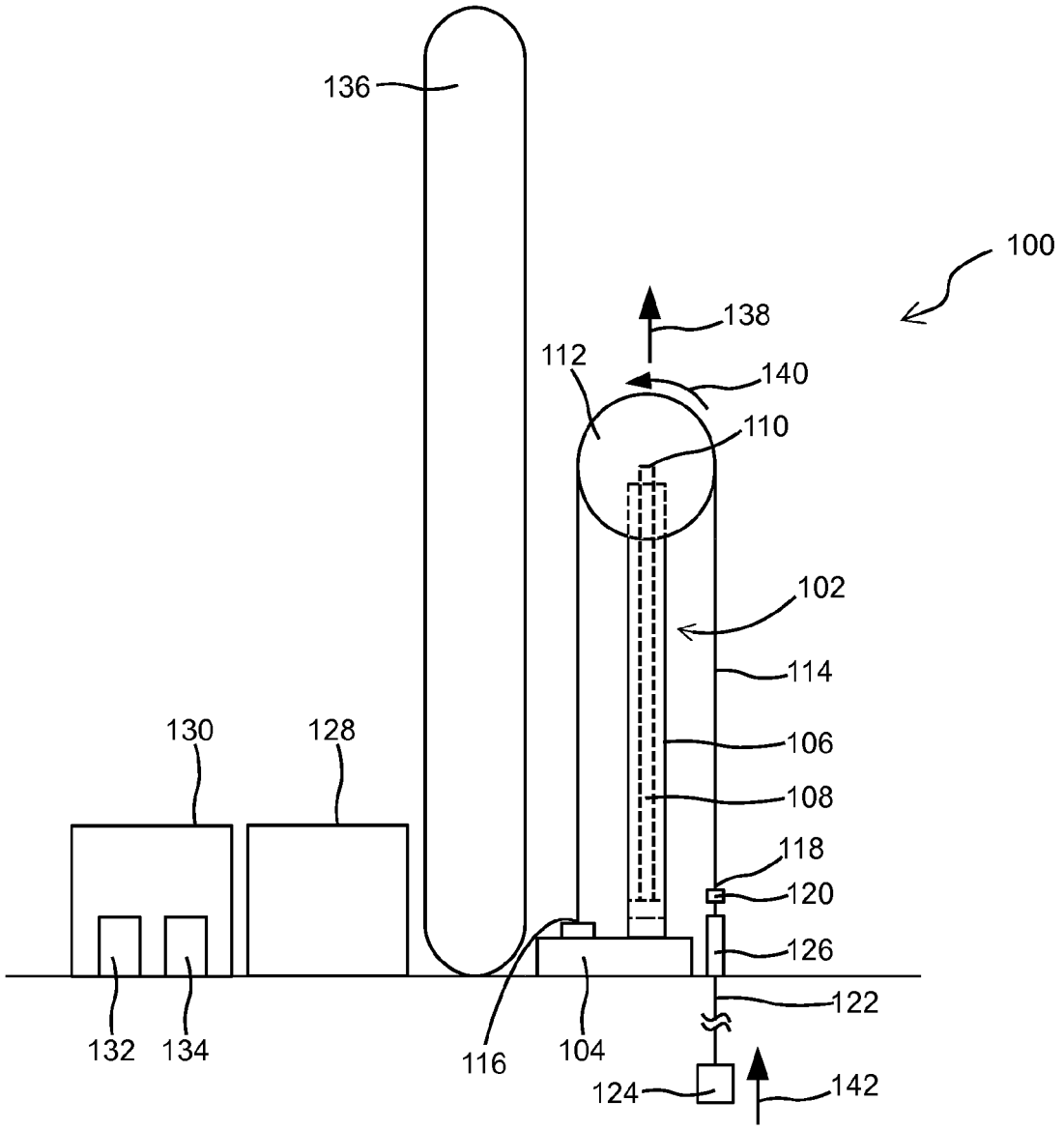
FIG. 1A is a schematic, partial cross-sectional, side view of a hydraulically-actuated rod pump system according to an embodiment of this disclosure.
Figure 1B:
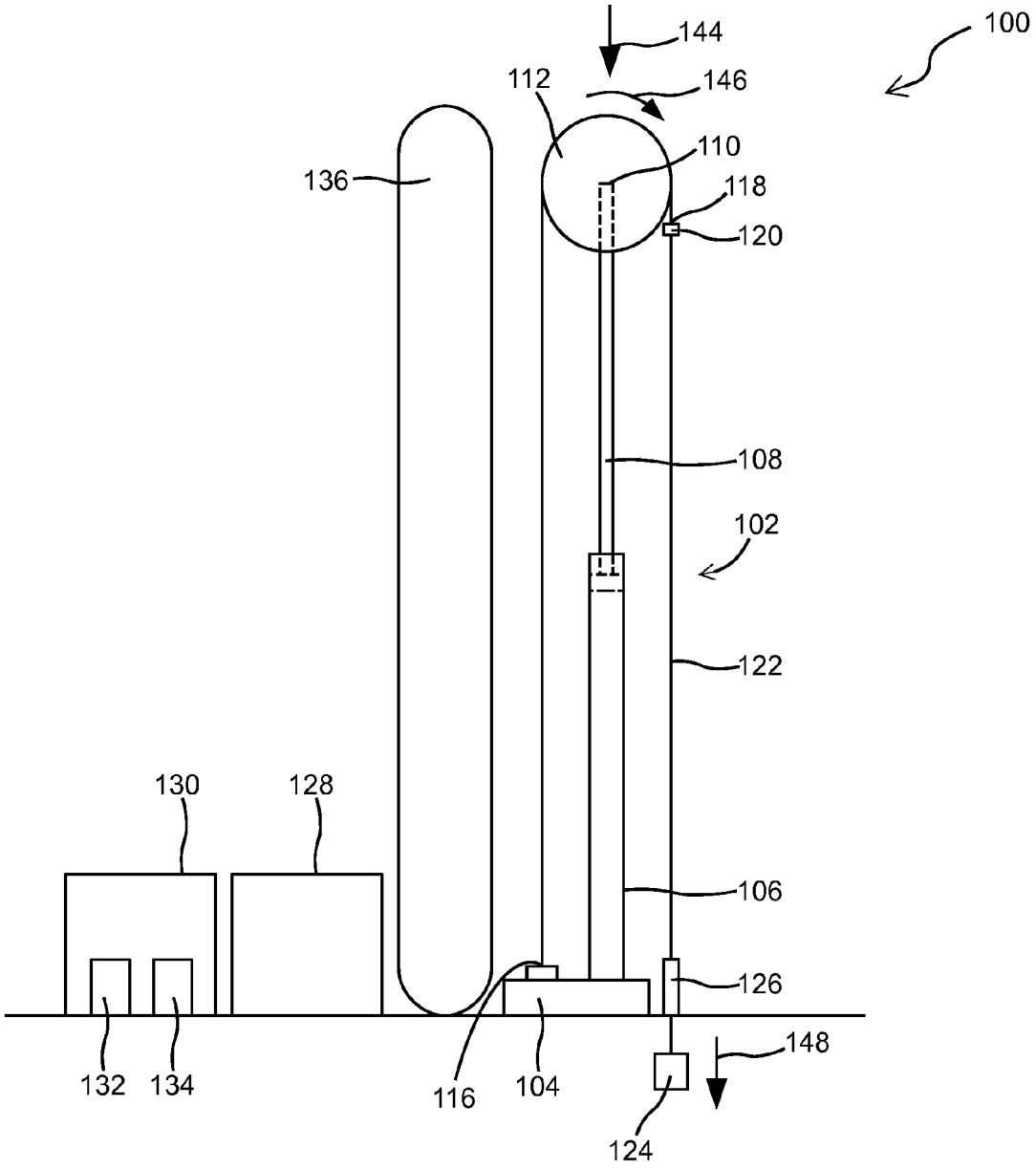
FIG. 1B is a schematic, partial cross-sectional, side view of the hydraulically-actuated rod pump system of FIG. 1A in a fully extended position.

Turning now to FIGS. 1A and 1B, a hydraulically-actuated rod pump system is shown and is generally identified by the numeral 100. The hydraulically-actuated rod pump system 100 comprises a vertically oriented jacking actuator 102 mounted or otherwise installed on a base 104. The jacking actuator 102 comprises a vertically oriented, elongated hydraulic cylinder 106, which receives a piston rod 108 axially movable therewithin. A pulley assembly 112 having one or more rotatable wheels is rotatably mounted to the top end 110 of the piston rod 108.

A set of cable 114 engages the wheels of the pulley assembly 112 about the upper radial section thereof. One end 116 of the cable 114 is connected to the base 104, and the other end 118 thereof is connected to a carrier bar 120, hanging under the pulley assembly 112. A sucker rod 122 is connected to the carrier bar 120 at one end, and connected at the other end a downhole pump 124 via a wellhead 126.

A hydraulic power unit 128 is connected to the hydraulic cylinder 106 via a set of conduits (not shown). The hydraulic power unit 128 comprises a power fluid reservoir (not shown) and a hydraulic motor (not shown) for pumping the power fluid from the power fluid reservoir into the hydraulic cylinder 106 to drive the piston rod 108 to reciprocate up and down. A position sensor (not shown), such as a position sensor manufactured by Celesco of Chatsworth, Calif., U.S.A., is mounted in the hydraulic cylinder 106 adjacent the piston rod 108 for measuring the position of the piston rod 108. Those skilled in the art appreciate that, in some alternative embodiments, other position sensors may be used. For example, in an alternative embodiment, a linear encoder may be used to monitor the cable 114 for determining the position of the piston rod 108. In another embodiment, a rotary encoder may be used for monitoring the rotation of the wheels of the pulley assembly 112 for determining the position of the piston rod 108.

An electrical unit 130 comprising an electrical power supply 132 and a control unit 134 provides electrical power to all necessary components, and controls the operation of the hydraulically-actuated rod pump system 100. A gas vessel 136 containing a suitable type of pressurized gas, such as pressurized nitrogen, is coupled to the hydraulic cylinder 106 via a set of conduits (not shown) for providing counterbalance to downhole components during operation.

Figure 2A:
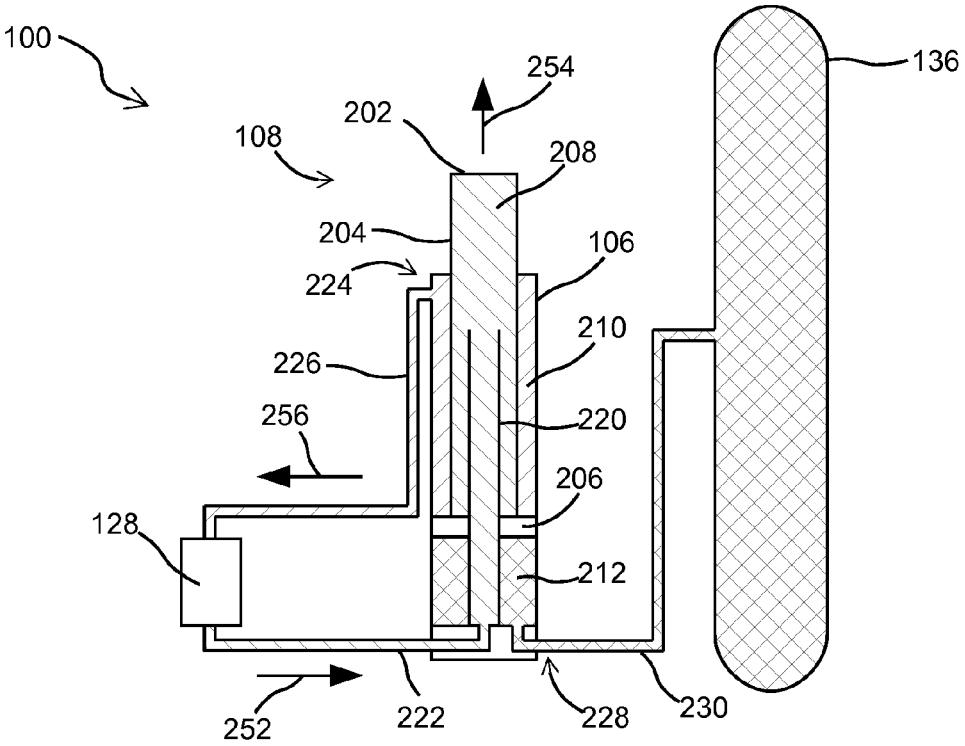
FIG. 2A is schematic cross-sectional view of the hydraulically-actuated rod pump system of FIG. 1A during an up-stroke.

FIG. 2A shows a schematic cross-sectional view of the hydraulically-actuated rod pump system 100 in operation during an up-stroke. For ease of illustration, only the hydraulic cylinder 106, piston rod 108, hydraulic power unit 128 and gas vessel 136 are shown.

As shown, the piston rod 108 has a top wall 202, a hollow cylinder body 204 with a diameter smaller than that of the hydraulic cylinder 106, and an radially extended piston 206 as the bottom wall thereof and sealably engaging the inner wall of the hydraulic cylinder 106. The top wall 202, hollow cylinder body 204 and the piston 206 thus forms an up chamber 208 for lifting the piston rod 108. The piston 206 also divides the hydraulic cylinder 106 into an upper portion forming a down chamber 210, and a lower portion forming a counterbalance gas chamber 212.

The piston 206 of the piston rod 108 comprise an opening receiving an up chamber inlet 220, which connects the up chamber 208 to the hydraulic power unit 128 via up-flow conduits 222.

The down chamber 210 of the hydraulic cylinder 106 comprises a down chamber inlet 224, connecting the down chamber 210 to the hydraulic power unit 128 via down-flow conduits 226.

The counterbalance gas chamber 212 comprises a gas inlet 228, connecting the counterbalance gas chamber 212 to the gas reservoir 136 via gas conduits 230.

Figure 1C:
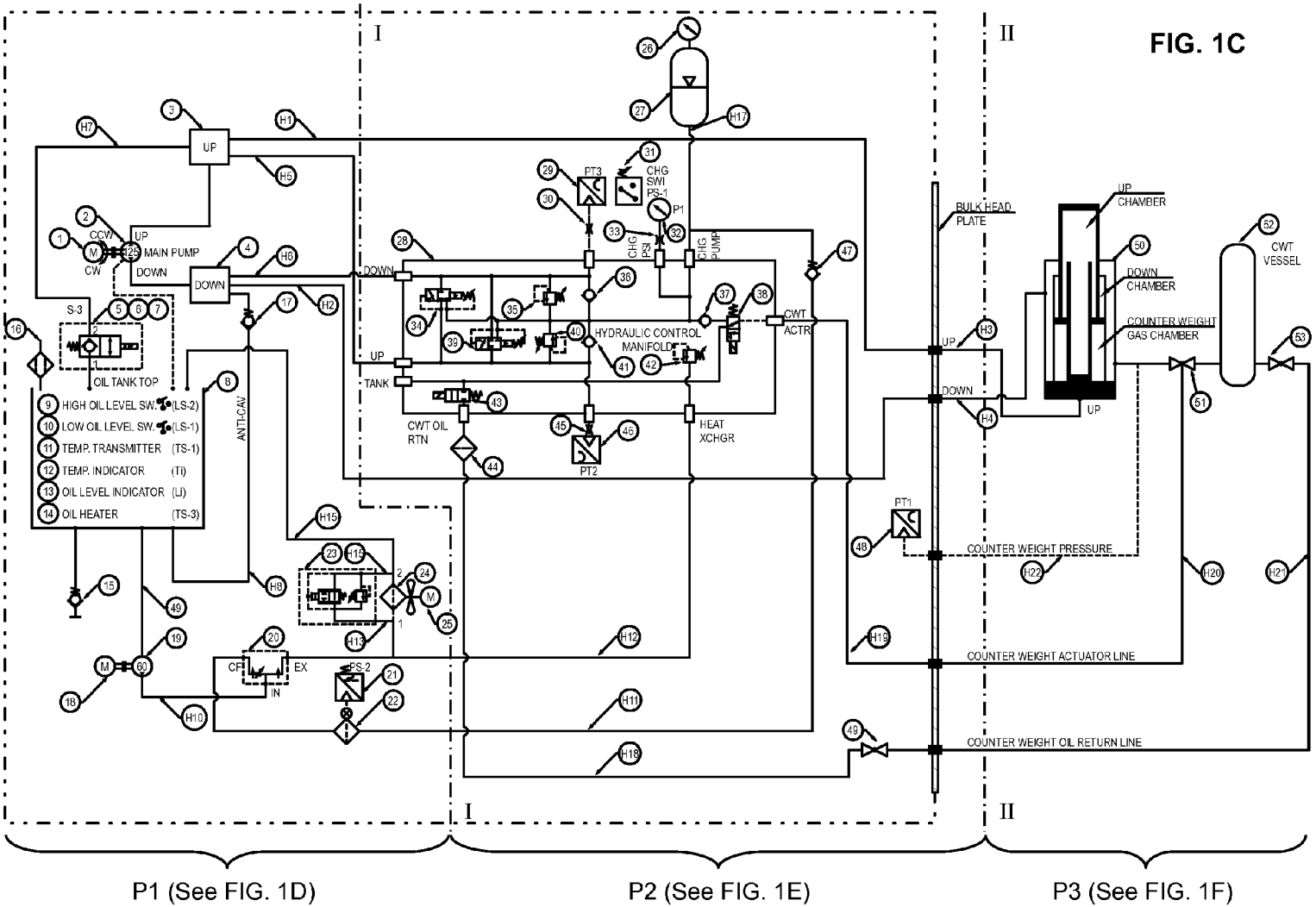
FIG. 1C is a schematic diagram of the hydraulically-actuated rod pump system of FIG. 1A showing the interconnection of components therebetween.
Figure 1D:
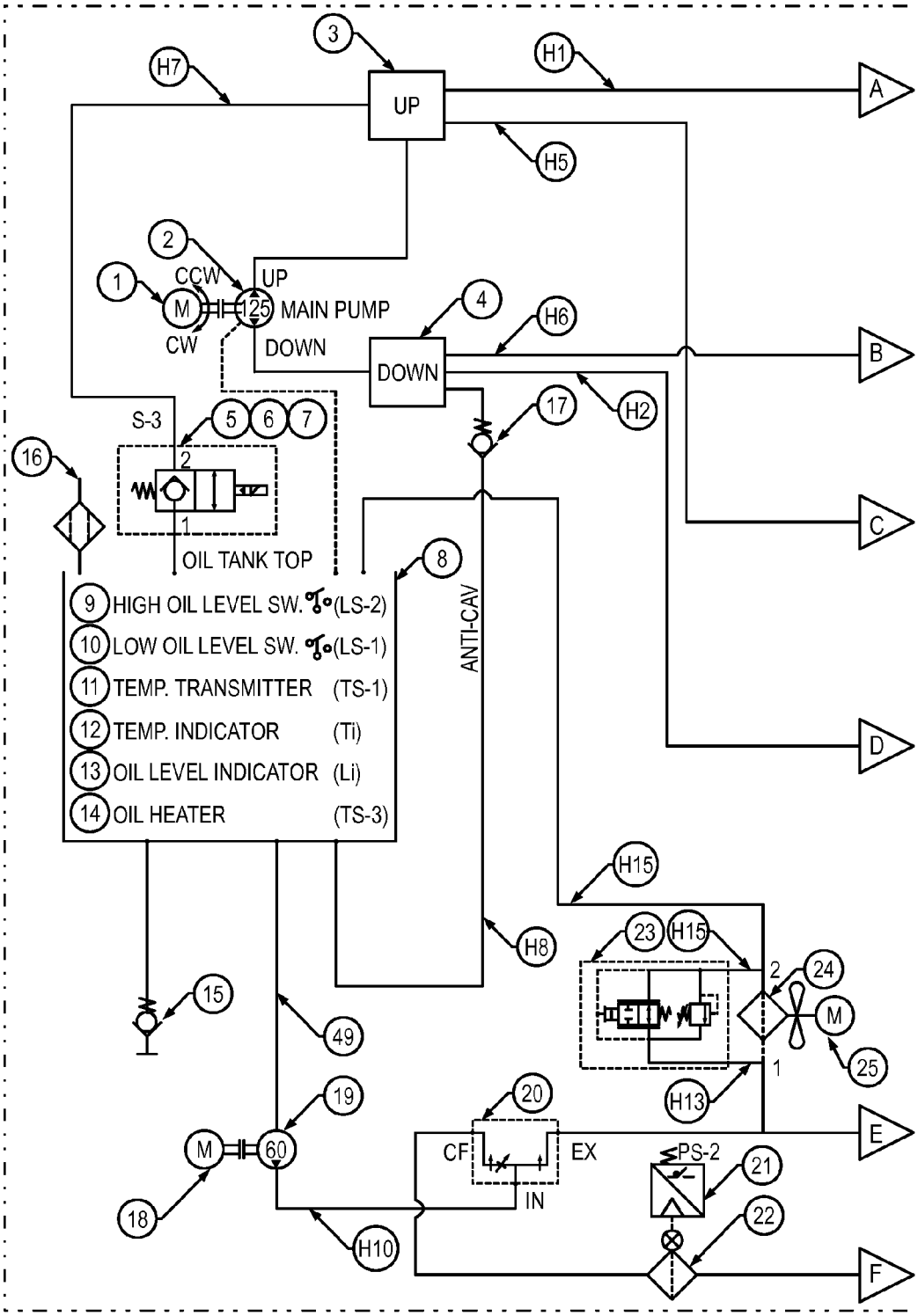
FIGS. 1D to 1F are enlarged drawings of FIG. 1C, more particularly.
Figure 1E:
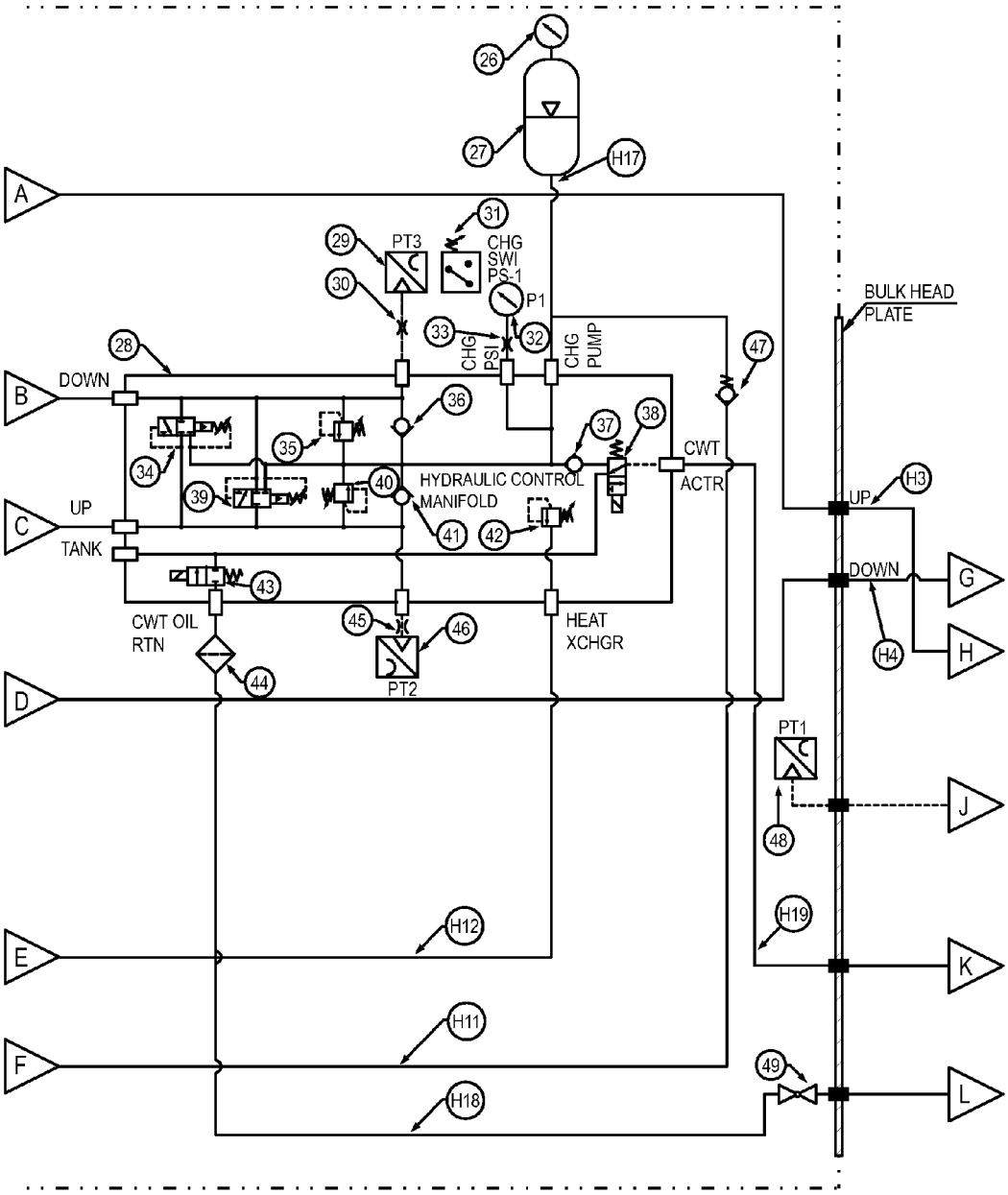
Figure 1F:
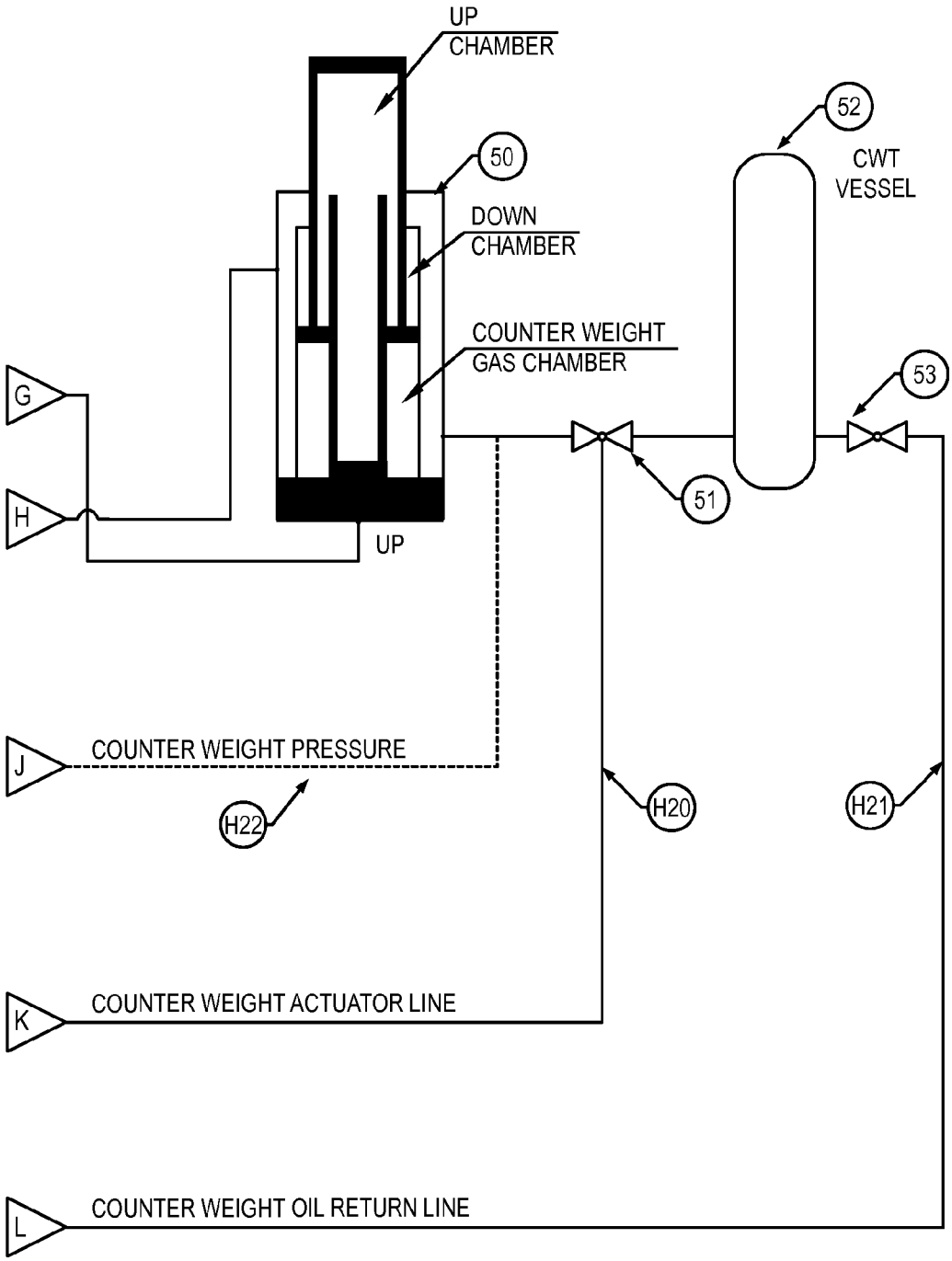

More detail of the hydraulically-actuated rod pump system 100 can be seen from FIG. 1C, which shows the interconnection of various components thereof. A detailed description of the working mechanism of the hydraulically-actuated rod pump may be found in U.S. Pat. No. 4,801,126, entitled "Hydraulically Operated Lift Mechanism" to Rosman, issued on Jan. 31, 1989, the content of which is incorporated herein by reference in its entirety. Generally, in operation, the hydraulic motor alternatively pumps power fluid into the up chamber 208 and the down chamber 210. In particular, during an up-stroke, the hydraulic motor pumps power fluid from the power fluid reservoir into the up chamber 208 via the up-flow conduits 222, as indicated by the arrow 252, to lift the piston rod 108 as indicated by the arrow 254. The power fluid in the down chamber 210 flows back to the power fluid reservoir via the down-flow conduits 226, as indicated by the arrow 256.

Figure 2B:
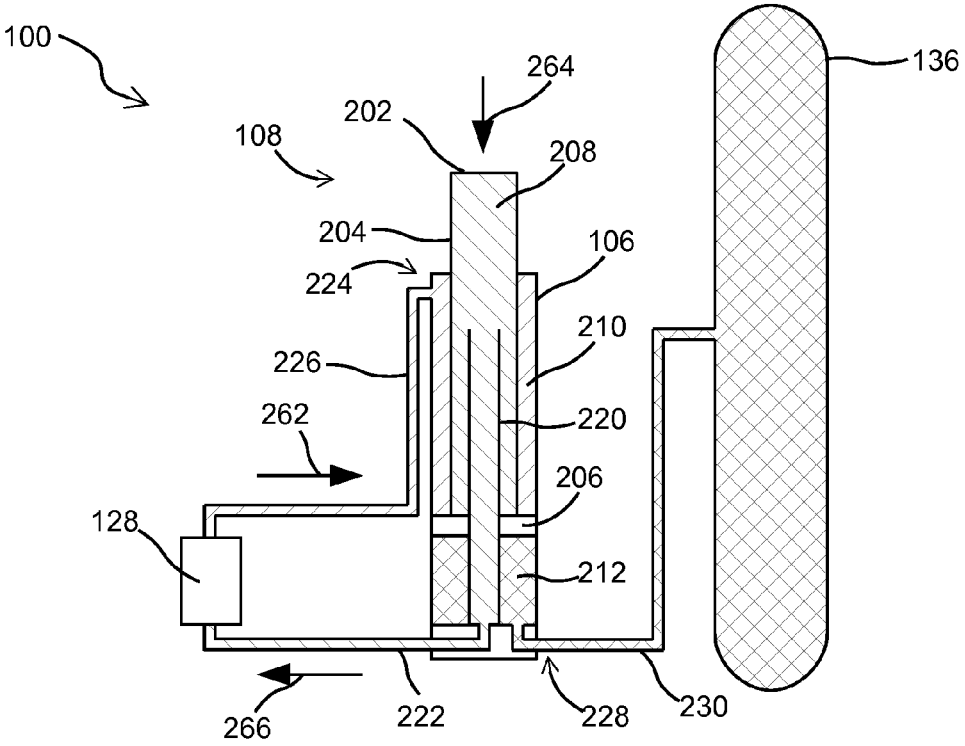
FIG. 2B is schematic cross-sectional view of the hydraulically-actuated rod pump system of FIG. 1A during a down-stroke.

As shown in FIG. 2B, during a down-stroke, the hydraulic motor pumps power fluid from the power fluid reservoir into the down chamber 210 via the down-flow conduits 226, as indicated by the arrow 262, to lower the piston rod 108 as indicted by the arrow 264. The power fluid in the up chamber 208 flows back to the power fluid reservoir via the up-flow conduits 222, as indicated by the arrow 266. During the down-stroke, the gas in the counterbalance gas chamber 212 is compressed, which provides weight counterbalance to the piston rod 108 to prevent it from abruptly falling down.

Referring back to FIGS. 1A and 1B, the hydraulic power unit 128 drives the piston rod 108 to reciprocate up and down. As shown in FIGS. 1A and 2A, during an up-stroke, the piston rod 108 is moving up as indicated by the arrow 138, raising the pulley assembly 112 mounted thereon. As the end 116 of the cable 114 is fixed to the base 104, the wheels of the raising pulley assembly 112 also rotates counter-clockwise as indicated by the arrow 140, pulling up the cable 114 and the carrier bar 120, and lifting the sucker rod 122 and the downhole pump 124 to pump fluid to the surface, as indicated by the arrow 142.

As shown in FIGS. 1B and 2B, during a down-stroke, the piston rod 108 is moving down as indicated by the arrow 144, lowering the pulley assembly 112 mounted thereon. As the end 116 of the cable 114 is fixed to the base 104, the weight of the sucker rod 122, downhole pump 124 and liquid therein causes the wheels of the pulley assembly 112 to rotate clockwise as indicated by the arrow 146, pulls down the cable 114, the carrier bar 120, and moves the sucker rod 122 and the downhole pump 124 to a downhole position ready for lifting fluid to surface in the subsequent up-stroke, as indicated by the arrow 148.

In this embodiment, the control unit 134 in the electrical unit 130, implemented as a Programmable Logic Controller (PLC) having a microprocessor, a memory, input/output interface and necessary circuitry, controls the operation of the hydraulically-actuated rod pump system 100 to reciprocate the piston rod 108 up and down for pumping fluid to the surface.

The control unit 134 stores a predefined top safety limit $H_{ST}$ representing a top limit that the piston rod 108 may be safely extended thereto, and a predefined bottom safety limit $H_{SB}$ representing a bottom limit that the piston rod 108 may be safely lowered thereto, both determined during manufacturing of system 100 and are not user-adjustable. Generally, for safety reasons, the top safety limit $H_{ST}$ is lower than the physical top limit that the piston rod 108 can be extended thereto, and the bottom safety limit $H_{SB}$ is higher than the physical bottom limit that the piston rod 108 can be lowered thereto.

The control unit 134 also stores a set of predefined piston rod up-stroke speeds and down-stroke speeds determined during manufacturing of system 100, at which the piston rod 108 may move during an up-stroke and a down-stroke, respectively. For example, in this embodiment, seven (7) up-stroke speeds and seven (7) down-stroke speeds are predefined and stored in the memory of the control unit 134. As will be described in more detail later, the up-stroke speed and the desired down-stroke speed may be independently set up by a user as required.

Figure 3A:
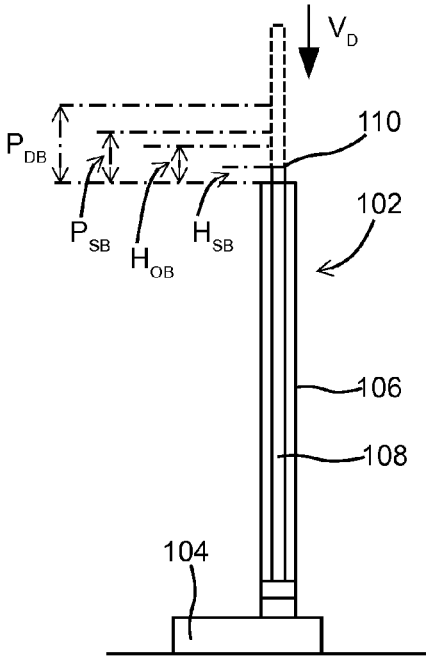
FIGS. 3A and 3B illustrate the piston rod position parameters used by the hydraulically-actuated rod pump system of FIG. 1A.
Figure 3B:
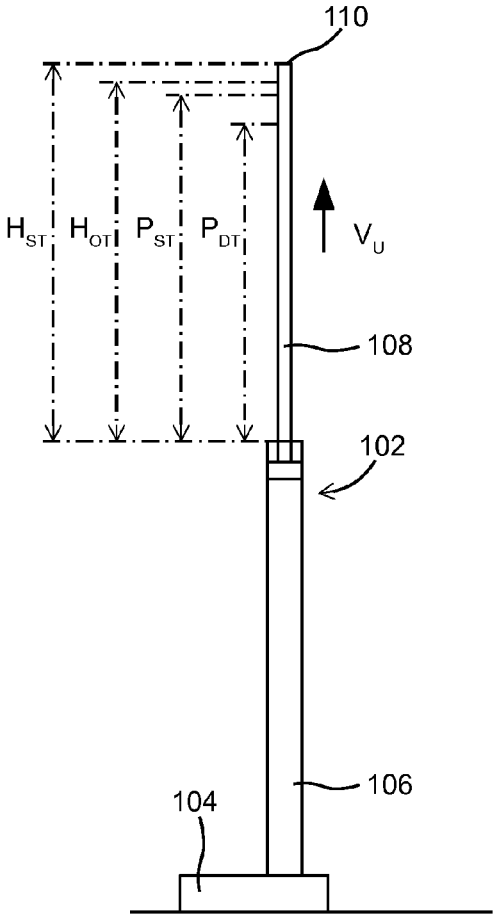

FIGS. 3A and 3B illustrates the piston rod position parameters used by the hydraulically-actuated rod pump system 100. For the ease of illustration, FIGS. 3A and 3B only shows the base 104, hydraulic cylinder 106 and the piston rod 108, all drawn in solid lines. The dashed lines illustrate a previous position of the piston rod 108.

As shown, during operation, the control unit 134 generally operates the piston rod 108 at a user-selected up-stroke speed $V_U$ and a user-selected down-stroke $V_D$, between a user-selected top operation limit $H_{OT}$ lower than the top safety limit $H_{ST}$, i.e., $H_{OT}<H_{ST}$, and a user-selected bottom operation limit $H_{OB}$ higher than the bottom safety limit $H_{SB}$, i.e., $H_{OB}>H_{SB}$. The stroke length S of an up- or down-stroke is then $$S=H_{OT}-H_{OB}.$$

However, as will be described later, the actual top and bottom stop positions $P_{ST}$ and $P_{SB}$ of the piston rod 108 may be different than $H_{OT}$ and $H_{OB}$, respectively, causing the actual stroke length S to vary normally within a relatively small range.

The control unit 134 calculates a top deceleration position $P_{DT}$ based on the up-stroke speed $V_U$, the top operation limit $H_{OT}$ and a predefined up-stroke deceleration rate, and calculates a bottom deceleration position $P_{DB}$ based on the down-stroke speed $V_D$, the bottom operation limit $H_{OB}$ and a predefined down-stroke deceleration rate.

During an up-stroke, the control unit 134 controls the hydraulic power unit 128 to move the piston rod 108 upward at the up-stroke speed $V_U$. When the piston rod 108 reaches the top deceleration position $P_{DT}$, the control unit 134 controls the hydraulic power unit 128 to decelerate the piston rod 108 to stop the piston rod 108 about the top operation limit $H_{OT}$.

Similarly, during a down-stroke, the control unit 134 controls the hydraulic power unit 128 to move the piston rod 108 downward at the down-stroke speed $V_D$. When the piston rod 108 reaches the bottom deceleration position $P_{DB}$, the control unit 134 controls the hydraulic power unit 128 to decelerate the piston rod 108 to stop the piston rod 108 about the bottom operation limit $H_{OB}$.

Although it is generally desirable to consistently and repeatedly stop the piston rod 108 at the top operation limit $H_{OT}$ during an up-stroke, and to stop the piston rod 108 at the bottom operation limit $H_{OB}$ during a down-stroke, the actual top and bottom stop positions $P_{ST}$ and $P_{SB}$ of the piston rod 108, respectively, may drift from the top and bottom operation limits $H_{OT}$ and $H_{OB}$ due to the change of operational factors including the environmental temperature and the load of the downhole pump.

In this embodiment, the control unit 134 provides a manual adjusting mode for users to manually adapt to top and bottom stop position drift, and an automatic adjusting mode for automatically adapting to top and bottom stop position drift. In the manual operation mode, a user has to observe any top or bottom position drift and manually adjust top and bottom deceleration positions $P_{DT}$ and $P_{DB}$. For example, if the actual top stop position $P_{ST}$ is higher than the top operation limit $H_{OT}$, then one can lower the top deceleration position $P_{DT}$. When the user need to change the up-stroke and/or down-stroke speed $V_U$ and $V_D$, the user has to first manually set up new top and/or bottom deceleration positions $P_{DT}$ and $P_{DB}$ based on the new up-stroke and/or down-stroke speed $V_U$ and $V_D$, and then change Vu and/or $V_D$.

In the automatic adjusting mode, the control unit 134 detects the actual top and bottom stop positions $P_{ST}$ and $P_{SB}$, and automatically adjusts the system operation to minimize detected drift to ensure that the piston rod stops about the top and bottom operation limits $H_{OT}$ and $H_{OB}$ within an allowable range.

Figure 4A:
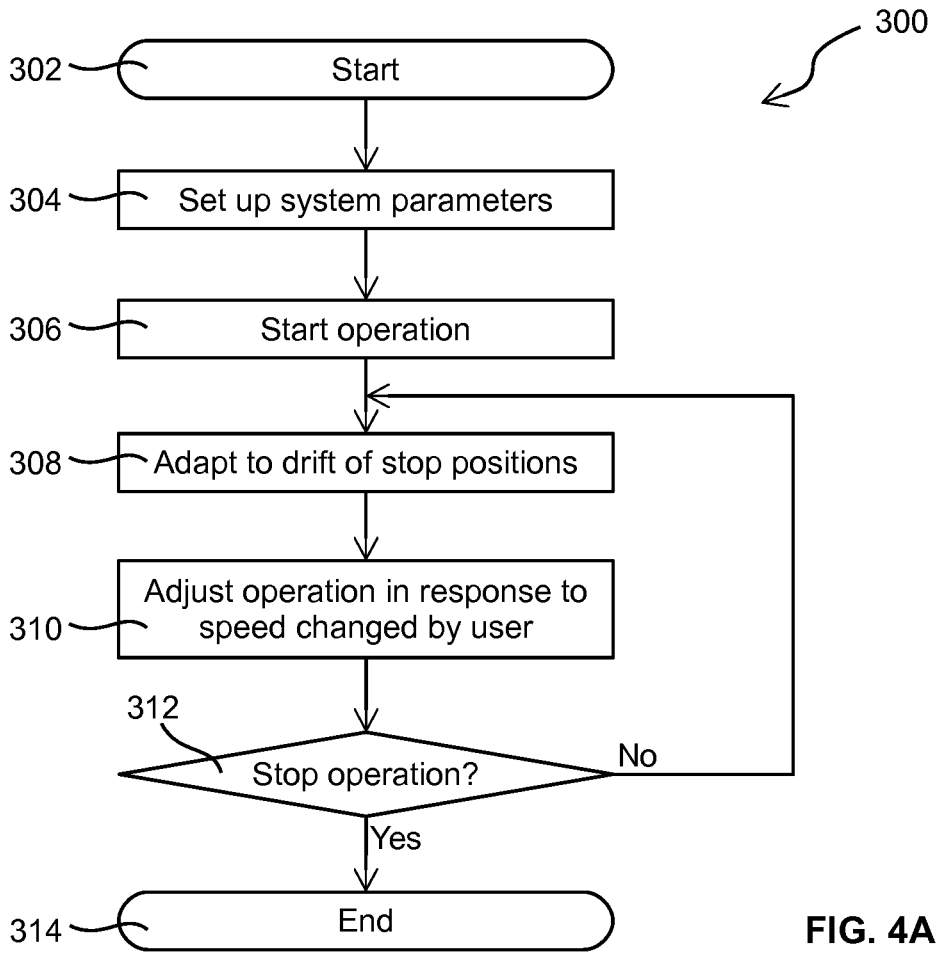
FIG. 4A is a flowchart showing a process of operating the hydraulically-actuated rod pump system of FIG. 1A, performed by the control unit in the automatic adjusting mode.

FIG. 4A is a flowchart showing a process 300 of operating the hydraulically-actuated rod pump system 100 performed by the control unit 134 in the automatic adjusting mode.

The process 300 starts (step 302) when the system 100 is first installed at a jobsite. After start, the control unit 134 first sets up required system parameters (step 304). In this embodiment, the control unit 134 comprises a touch-sensitive screen (not shown) and provides a graphic user interface (GUI) thereon for users to input required system parameters, including the up-stroke and down-stroke speeds $V_U$ and $V_D$ and the top and bottom operation limits $H_{OT}$ and $H_{OB}$. The control unit 134 also provides a job mode to facilitate users to determine the top and bottom operation limits $H_{OT}$ and $H_{OB}$.

Figure 4B:
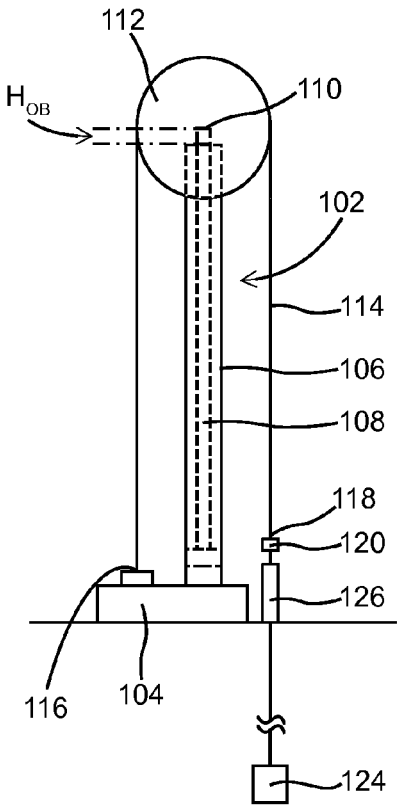
FIGS. 4B and 4C illustrate the hydraulically-actuated rod pump system of FIG. 1A during the determination of the top and bottom operation limits $H_{OT}$ and $H_{OB}$.
Figure 4C:
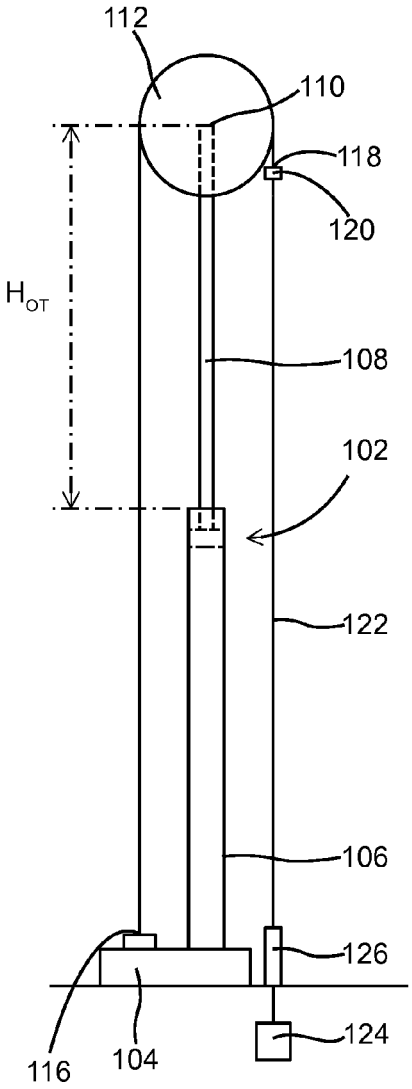

FIGS. 4B and 4C illustrate the system 100 during the determination of the top and bottom operation limits $H_{OT}$ and $H_{OB}$. For ease of illustration, some components of system 100 are omitted.

As shown in FIG. 4B, in the jog mode, the control unit 134 gradually lowers the piston rod 108 under the control of a special user such as a system administrator, to a lowest position suitable for normal operation. Such a lowest position is the piston rod position at which the downhole pump is moved to the furthest downhole position and at which the carrier bar 120 is adjacent to the wellhead 126 spaced by a suitable safe distance. Other conditions may also be applied in determining the lowest position. Generally, it is required that the lowest position would not be lower than the bottom safety limit $H_{SB}$.

The administrator then obtains a position reading from the position sensor (not shown) regarding the position of the piston rod 108 with respect to a predefined reference point, e.g., the top end of the hydraulic cylinder 106, the base 104, the ground or the like. The obtained position reading is used as the bottom operation limit $H_{OB}$.

As shown in FIG. 4C, the control unit 134 then gradually lifts the piston rod 108 under the control of the administrator, to a highest position suitable for normal operation. Such a highest position is the piston rod position at which the carrier bar 120 is adjacent to the pulley assembly 112 at a suitable safe distance and the downhole pump is lifted to a highest position within its operation range. Other conditions may also be applied in determining the highest position. Generally, it is required that the highest position would not be higher than the top safety limit $H_{ST}$.

The administrator then obtains a position reading from the position sensor (not shown) regarding the position of the piston rod 108 with respect to the predefined reference point. The obtained position reading is used as the top operation limit $H_{OT}$.

Referring back to FIG. 4A, after setting up system parameters, the control unit 134 starts system operations (step 306). At this step, the control unit 134 first performs an initialization process to automatically control the system 100 to initialize the up-stroke and down-stroke operation, and then enters normal operation after the initialization is finished.

The purpose of initializing the up- and down-stroke operation is to smoothly and safely adapt the system to the top and bottom operation limit $H_{OT}$ and $H_{OB}$ of the piston rod 108.

In one embodiment, the initialization process starts by operating the piston rod 108 between an initial top stop position $H_{T1}$ and initial bottom stop position $H_{B1}$ about the mid-point of the top and bottom operation limit $H_{OT}$ and $H_{OB}$. The stroke length is incrementally increased until reaching the operation limit $H_{OT}$ and $H_{OB}$. In an embodiment, the available differential stroke between the initial stop positions $H_{T1}$, $H_{B1}$ and limit $H_{OT}$ and $H_{OB}$ can be divided into a known number of incremental step values.

In this embodiment, the piston rod 108 is be operated with an adequately small initial stroke length $S_1$, i.e., $$S_1=C_1S_N,$$

where $S_1=H_{T1}-H_{B1}$ is the initial stroke length, $C_1$ is a predefined ratio, which in this embodiment is $C_1=60\%$, and $S_N=H_{OT}-H_{OB}$ is the desired normal stroke length. Therefore, the initial top stop position $H_{T1}$ is below the top operation limit $H_{OT}$ with a distance of $(1-C_1)S_N/2$, and the initial bottom stop position $H_{B1}$ is above the bottom operation limit $H_{OB}$ with a distance of $(1-C_1)S_N/2$.

The control unit 134 then controls the piston rod 108 to reciprocate up and down and, by adjusting the up- and down-stroke deceleration positions, gradually expanding the stroke length. In this embodiment, the expansion of stroke length may comprise a coarse expansion stage, at which the control unit 134 extends the top/bottom stop position towards $H_{OT}/H_{OB}$, respectively, in an up-/down-stroke by a relatively large extension step value Δc, until no longer practical. Thereafter, expansion of the stroke length occurs by a fine expansion stage, at which the control unit 134 extends the top/bottom stop position more carefully towards $H_{OT}/H_{OB}$, in an up-/down-stroke by a relatively small extension step value ΔF. In this embodiment, the step values are appropriate for dimensions typical of rod pump operation, $\Delta_C=5$ inches and $\Delta_F=1$ inch. Of course, $\Delta_C$, and $\Delta_F$ may take other suitable values in alternative embodiments.

Figure 5A:
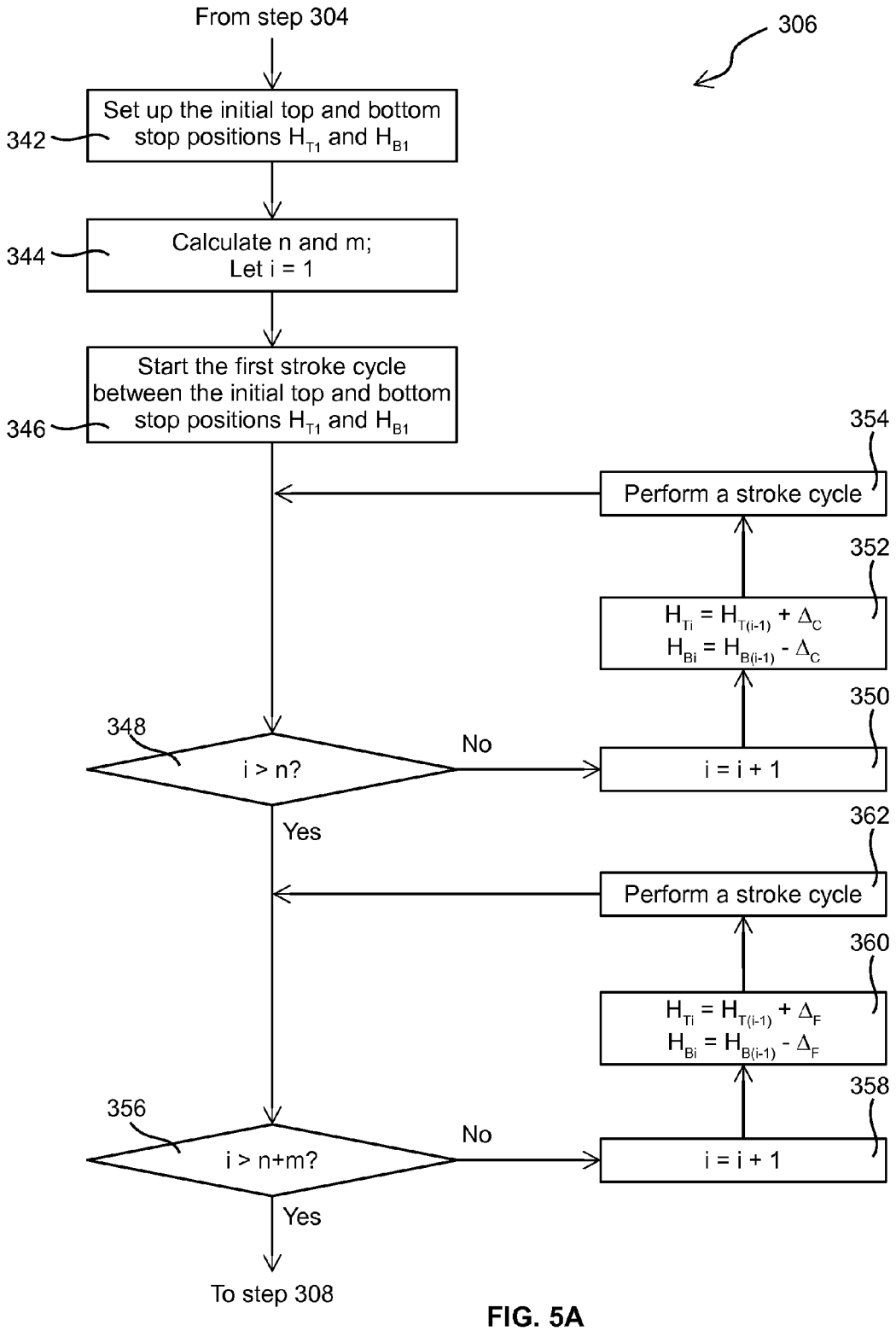
FIG. 5 shows an example of the initialization process.
Figure 5B:
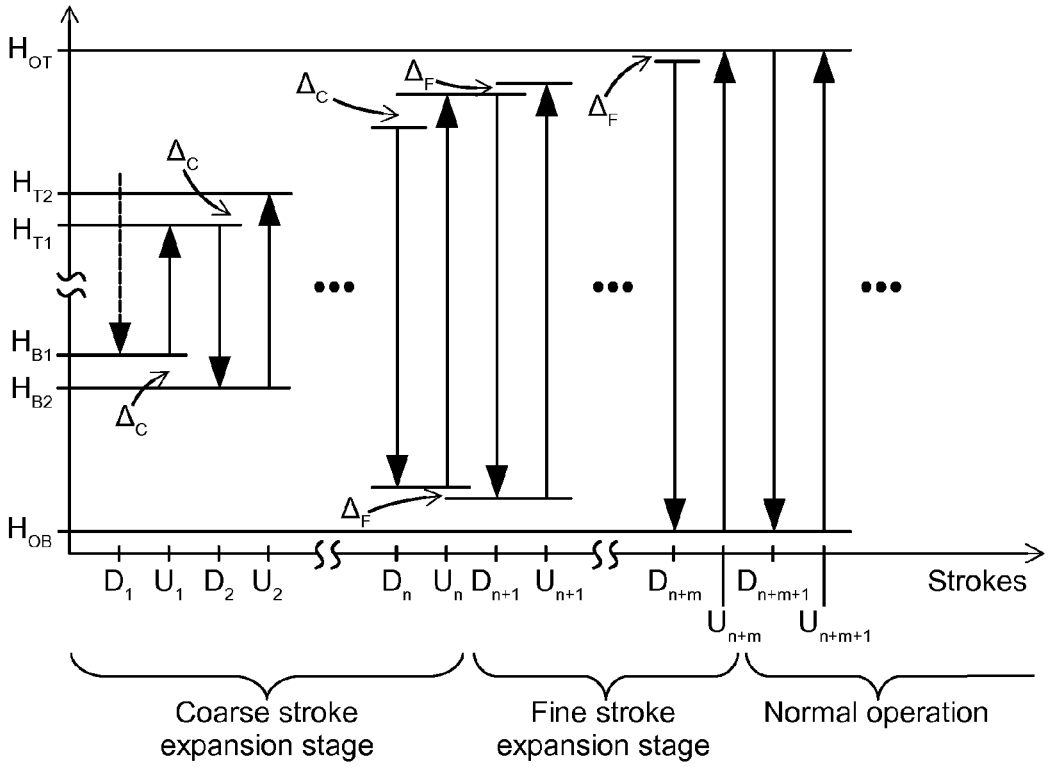

FIGS. 5A and 5B show an example of the start or initialization process 306 of FIG. 4A. The control unit 134 first sets up the initial top and bottom stop positions $H_{T1}$ and $H_{B1}$ (step 342), and calculates the number n of stroke cycles required in a coarse-expansion stage, and the number m of stroke cycles required in the fine expansion stage (step 344) based on a stage-transition stroke length $S_T$ predefined as:

$$S_T=S_N-2S_F,$$

where $S_F$ is a predefined distance that the top/bottom stop position will be expanded in the fine expansion stage, which in this embodiment is $S_F=10$ inches. Therefore, n and m are calculated as, respectively, $$n=(H_{OT}-S_F-H_{T1})/\Delta_C;$$

$$m=S_F/\Delta_F.$$

Those skilled in the art appreciate that the control unit 134 may adjust $S_F$ and $H_{T1}$ to ensure that n and m are integers.

At step 344, the control unit 134 also initialize a stroke cycling loop by setting an internal variable i to 1. Then the control unit 134 starts the first stroke cycle of the piston rod 108 between the initial top and bottom stop positions $H_{T1}$ and $H_{B1}$ (step 346).

As illustrated in FIG. 5B, in the first down-stroke $D_1$, the control unit 134 moves the piston rod 108 to the initial bottom stop position $H_{B1}$, and then moves the piston rod 108 to the initial top stop position $H_{T1}$ in the first up-stroke $U_1$ to complete the first stroke cycle.

Referring back to FIG. 5A, the control unit 134 then checks if i is greater than n (step 348). If not, the control unit increases i by 1 (step 350), and then raises the top stop position as $H_{Ti}=H_{T(i-1)}+\Delta_C$, and lowers the bottom stop position as $H_{Bi}=H_{B(i-1)}-\Delta_C$ (step 352). The control unit 134 then controls the piston rod 108 to perform a stroke cycle (step 354).

As illustrated in FIG. 5B, in the down-stroke $D_2$, the control unit moves the piston rod 108 to an expanded bottom stop position $H_{B2}=H_{B1}-\Delta c$. Similarly, in the successive up-stroke $U_2$, the control unit 134 moves the piston rod 108 to an expanded top stop position $H_{T2}=H_{T1}+\Delta_C$.

Referring back to FIG. 5A, the process goes back to step 348 to check if i is greater than n. In this manner, the top and bottom stop positions of the piston rod 108 are expanded for n stroke cycles, wherein the control unit 134 lowers the bottom stop position $H_B$ by a relatively large stroke expansion step value $\Delta_C$ in each down-stroke, and raises the top stop position $H_T$ by $\Delta_C$ in each up-stroke.

When at step 348 the control unit 134 determines that i is greater than n, the process enters the fine stroke expansion stage.

At step 356, the control unit 134 check if i is greater than (n+m). If not, the control unit increases i by 1 (step 358), and then raises the top stop position as $H_{Ti}=H_{T(i-1)}+\Delta_F$, and lowers the bottom stop position as $H_{Bi}=H_{B(i-1)}-\Delta F$ (step 360). The control unit 134 then controls the piston rod 108 to perform a stroke cycle (step 362).

As illustrated in FIG. 5B, in the first down stroke $D_{n+1}$ of the fine stroke expansion stage, i.e., in the overall (n+1)-th down-stroke, the control unit 134 moves the piston rod 108 to an expanded bottom position $H_{B(n+1)}=H_{Bn}-\Delta_F$, where $H_{Bn}$ is the stop position of the last down-stroke $D_n$ in the coarse stroke expansion stage (i.e., overall n-th down-stroke). In the successive up-stroke $U_{n+1}$, the control unit 134 moves the piston rod 108 to an expanded top position $H_{T(n+1)}=H_{Tn}+\Delta_F$, where $H_{Tn}$ is the stop position of the last up-stroke $U_n$ in the coarse stroke expansion stage (i.e., overall n-th up-stroke).

Referring back to FIG. 5A, the process goes back to step 356 to check if i is greater than (n+m). In this manner, the top and bottom stop positions of the piston rod 108 are expanded for m stroke cycles, wherein the control unit 134 lowers the bottom stop position $H_B$ by a relatively small stroke expansion step value $\Delta_F$ in each down-stroke, and raises the top stop position $H_T$ by $\Delta_F$ in each up-stroke, to expand the top and bottom stop positions of the piston rod 108, respectively, to the top and bottom operation limits $H_{OT}$ and $H_{OB}$.

When the control unit 134 determines at step 356 than i is greater than (n+m), the initialization process is then completed, and the control unit 134 controls the piston rod 108 in normal operation mode, reciprocating up and down between the top and bottom operation limits $H_{OT}$ and $H_{OB}$. The process then goes to step 308 of FIG. 4A.

Referring back to FIG. 4A, during normal operation, the control unit 134 automatically adapts the system 100 to any drift of the top and bottom stop positions (step 308).

In this embodiment, the control unit 134 detects drift of the top and bottom stop positions, and calculates automatically adjusts the top and bottom deceleration positions $P_{DT}$ and $P_{DB}$, respectively. The control unit 134 then adjusts the hydraulic power unit 128 in accordance to the adjusted top and bottom deceleration positions $P_{DT}$ and $P_{DB}$ to minimize detected drift of the top and bottom stop positions, respectively.

Figure 6:
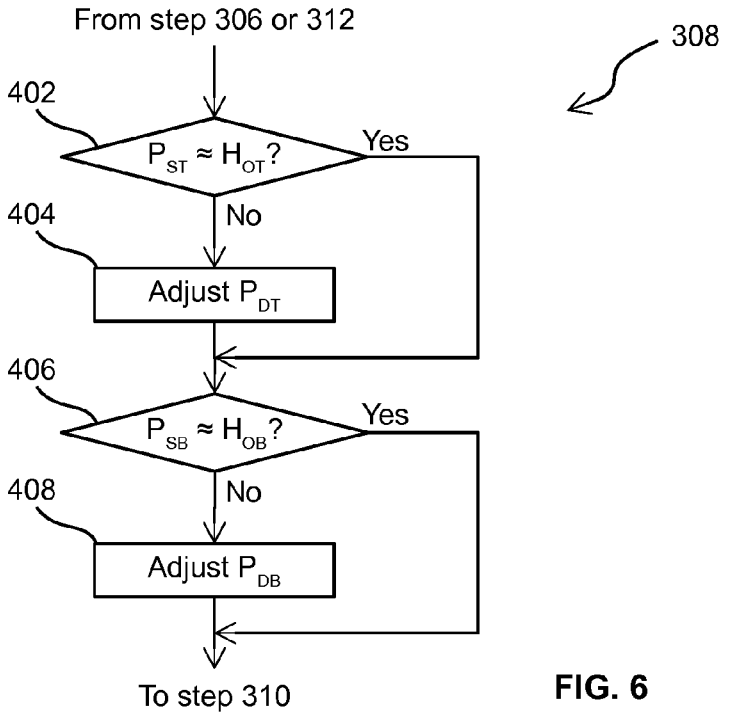
FIG. 6 shows the detailed steps for adjusting the top and bottom deceleration positions $P_{DT}$ and $P_{DB}$.

FIG. 6 shows the detailed steps for adjusting $P_{DT}$ and $P_{DB}$. In each up-stroke, the control unit 134 receives position information from the position sensor to detect the actual top stop position $P_{ST}$ of the piston rod 108, and checks whether the actual top stop position $P_{ST}$ is about the top operation limit $H_{OT}$, which is the target top stop position, within a predefined accuracy range, i.e., $P_{ST} \approx H_{OT}$ (step 402). If yes, the process branches to step 406; otherwise, top stop position drift occurs, and the control unit 134 adjusts the top deceleration position $P_{DT}$ to minimize the drift (step 404). At this step, the control unit 134 calculates the difference $L_T$ between the actual top stop position $P_{ST}$ and the top operation limit $H_{OT}$:

$$L_T = P_{ST} - H_{OT}.$$

Obviously, $L_T > 0$ if $P_{ST} > H_{OT}$, and $L_T < 0$ if $P_{ST} < H_{OT}$. Then, the control unit 134 adjusts the top deceleration position $P_{DT}$ as:

$$P_{DT}' = P_{DT} - L_T.$$

Figure 7A:
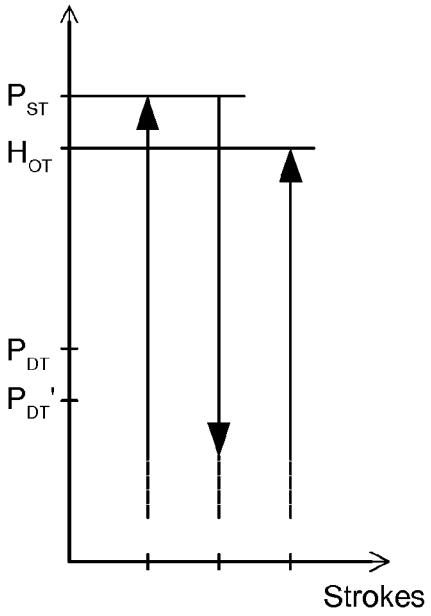
FIGS. 7A and 7B illustrate the adjustment of the top deceleration position $P_{DT}$ following the steps of FIG. 6.
Figure 7B:
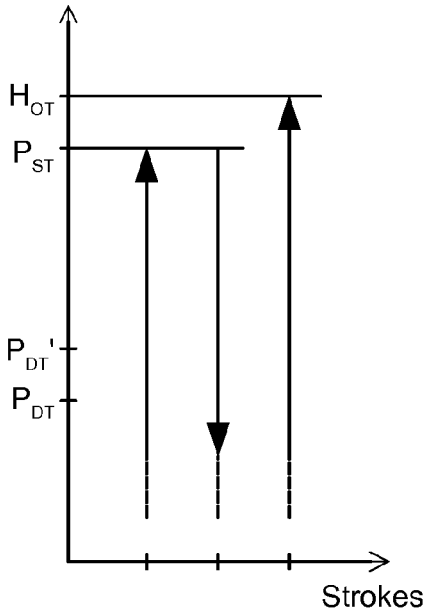

That is, the adjusted top deceleration position $P_{DT}'$ is lowered by a distance of $(P_{ST} - H_{OT})$ if $P_{ST} > H_{OT}$, as shown in FIG. 7A; and the adjusted top deceleration position $P_{DT}'$ is raised by a distance of $(H_{OT} - P_{ST})$ if $P_{ST} < H_{OT}$, as shown in FIG. 7B. The process then goes to step 406.

In each down-stroke, the control unit 134 receives position information from the position sensor to detect the bottom stop position $P_{SB}$ of the piston rod 108, and checks whether the bottom stop position $P_{SB}$ is about the bottom operation limit $H_{OB}$, which is the target bottom stop position, within a predefined accuracy range, i.e., $P_{SB} \approx H_{OB}$ (step 406). If yes, the process branches to step 310 of FIG. 4A; otherwise, bottom stop position drift occurs, and the control unit 134 adjusts the bottom deceleration position $P_{DB}$ to minimize the drift (step 408). At this step, the control unit 134 calculates the difference $L_B$ between the actual bottom stop position $P_{ST}$ and the bottom operation limit $H_{OB}$:

$$L_B = P_{SB} - H_{OB}.$$

Obviously, $L_B > 0$ if $P_{SB} > H_{OB}$, and $L_B < 0$ if $P_{SB} < H_{OB}$. Then, the control unit 134 adjusts the bottom deceleration position $P_{DB}$ as:

$$P_{DB}' = P_{DB} - L_B.$$

Figure 8A:
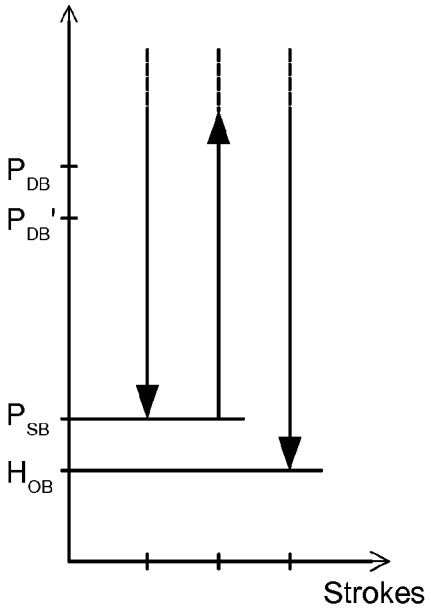
FIGS. 8A and 8B illustrate the adjustment of the bottom deceleration position $P_{DT}$ following the steps of FIG. 6.
Figure 8B:
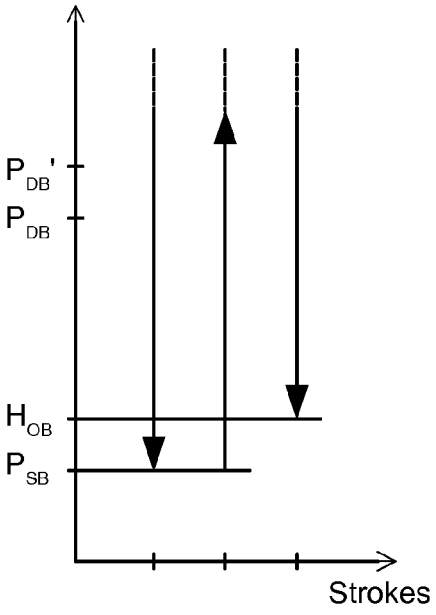

That is, the adjusted bottom deceleration position $P_{DB}'$ is lowered by a distance of $(P_{SB} - H_{OB})$ if $P_{SB} > H_{OB}$, as shown in FIG. 8A; and the adjusted bottom deceleration position $P_{DB}'$ is raised by a distance of $(H_{OB} - P_{SB})$ if $P_{SB} < H_{OB}$, as shown in FIG. 8B. The process then goes to step 310 of FIG. 4A.

Referring back to FIG. 4A, the control unit 134 also monitors user input during system operation to determine if a user has selected a different up-stroke or down-stroke speed, and adjusts system operation accordingly (step 310).

As described above, in this embodiment, the control unit 134 comprises a touch-sensitive screen (not shown). The control unit 134 provides a graphic user interface (GUI) on the touch-sensitive screen for users to adjust the up- and/or down-stroke speed by selecting one of seven (7) predefined speeds. In response to an up- and/or down-stroke speed change, the control unit 134 re-initializes the system operation to adapt to the adjusted up- and/or down-stroke speed (step 320).

The control unit 134 first calculates the number p of stroke cycles required in coarse-expansion stage, and the number q of stroke cycles required in the fine expansion stage, in a manner similar to the calculation of n and m in FIGS. 5A and 5B. Then, the control unit 134 re-initializes the top stop position if the up-stroke speed is changed, and re-initializes the bottom stop position if the down-stroke speed is changed. The control unit 134 re-initializes both the top and bottom stop position if the up- and down-stroke speeds are changed.

Figure 9:
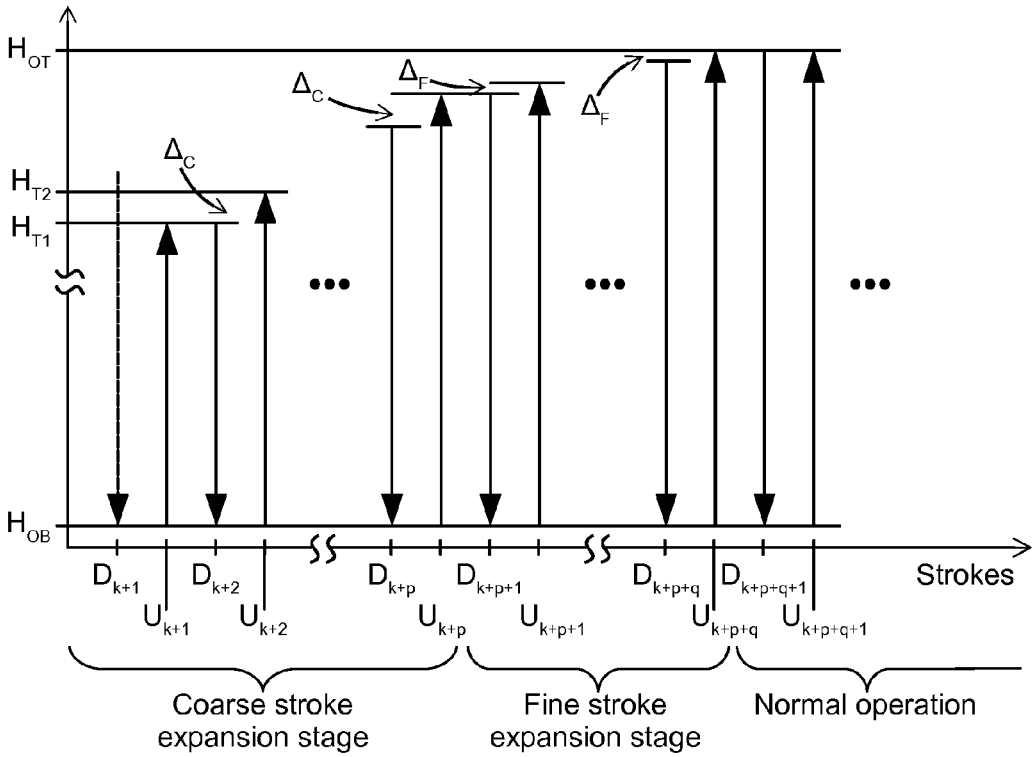
FIG. 9 shows an example of the re-initialization process when, after k stroke cycles, the up-stroke speed $V_U$ is changed by a user but the down-stroke speed $V_D$ is unchanged.

FIG. 9 shows an example of the re-initialization process, when, after k stroke cycles, the up-stroke speed $V_U$ is changed by a user but the down-stroke speed $V_D$ is unchanged. In this example, the control unit 134 continues to lower the piston rod 108 to the bottom operation limit $H_{OB}$ in a series of down-strokes and gradually raises the top stop position $H_T$ of the piston rod 108 in steps from an initial top stop position $H_{T1}$, which is below the top operation limit $H_{OT}$ with a distance of $(1-C_1)S_N/2$, to the top operation limit $H_{OT}$ via a coarse stroke expansion stage and, as the stroke closely approaches top operation limit $H_{OT}$, in a fine stroke expansion stage.

At the first re-initialization down-stroke $D_{k+1}$, i.e., the overall (k+1)-th down stroke, the control unit 134 lowers the piston rod 108 to the bottom operation limit $H_{OB}$. In the successive up-stroke $U_{k+1}$, the control unit 134 lifts the piston rod 108 to the predefined initial top stop position $H_{T1}$.

In the next down-stroke $D_{k+2}$, the control unit 134 lowers the piston rod 108 to the bottom operation limit $H_{OB}$, and lifts the piston rod 108 to an expanded top stop position $H_{T2} = H_{T1} + \Delta_C$ in the next up-stroke $U_{k+2}$.

In this manner, the top stop position of the piston rod 108 is expanded for p stroke cycles, wherein the control unit 134 continues to lower the piston rod to the bottom operation limit $H_{OB}$ in each down-stroke, and raises the top stop position $H_T$ by a relatively large stroke expansion step value $\Delta_C$ in each up-stroke. When the spacing between the top operation limit $H_{OT}$ and the last upstroke is less than or equal to the coarse step $\Delta_C$, then the process then enters the fine stroke expansion stage.

At the first down-stroke $D_{k+p+1}$ of the fine stroke expansion stage, i.e., the overall (k+p+1)-th down-stroke, the control unit 134 lowers the piston rod 108 to the bottom operation limit $H_{OB}$, and lifts the piston rod 108 to an expanded top stop position $H_{T(p+1)} = H_{Tp} + \Delta_F$ in the successive up-stroke $U_{k+p+1}$, where $H_{Tp}$ represents the stop position of the last up-stroke $U_{k+p}$ in the coarse stroke expansion stage (i.e., overall (k+p)-th up-stroke).

In this manner, the top stop position of the piston rod 108 is expanded for q stroke cycles, wherein the control unit 134 lowers the piston rod to the bottom operation limit $H_{OB}$ in each down-stroke, and raises the top stop position $H_T$ by a relatively small stroke expansion step value $\Delta_F$ in each up-stroke, to expand the top stop position of the piston rod 108 to the top operation limit $H_{OT}$. The re-initialization process is then completed, and the control unit 134 controls the piston rod 108 into the normal operation, reciprocating up and down between the top and bottom operation limits $H_{OT}$ and $H_{OB}$.

Figure 10:
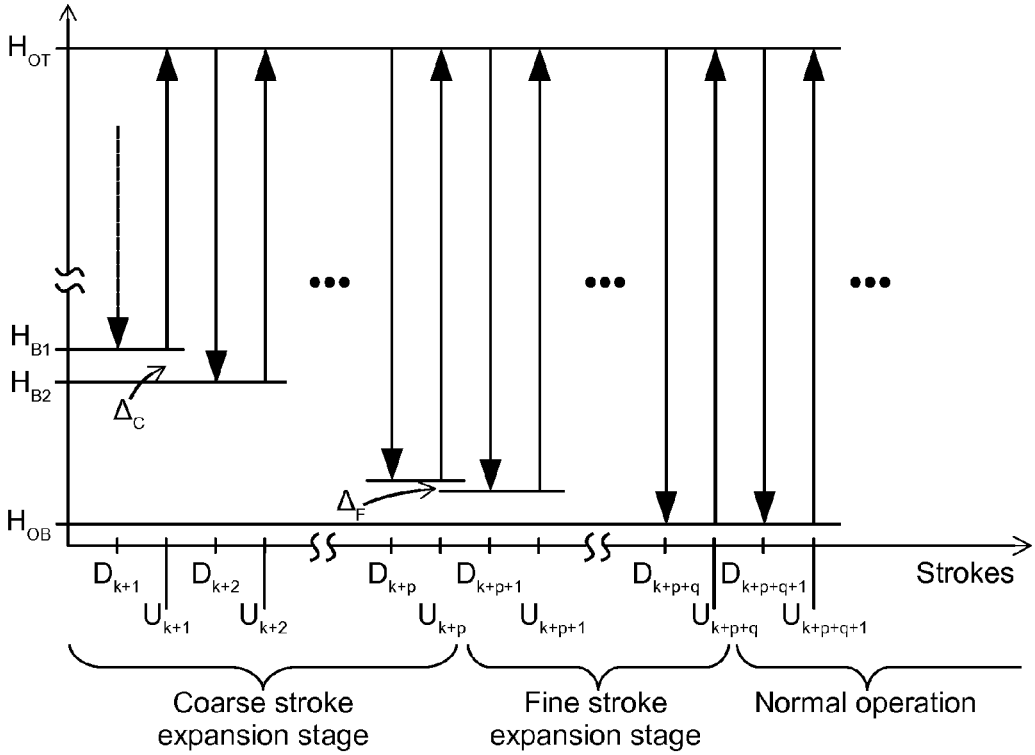
FIG. 10 shows an example of the re-initialization process when, after k stroke cycles, the down-stroke speed $V_D$ is changed by a user but the up-stroke speed $V_U$ is unchanged.

FIG. 10 shows an example of the re-initialization process when, after k stroke cycles, the down-stroke speed $V_D$ is changed by a user but the up-stroke speed $V_U$ is unchanged. In this example, the control unit 134 always lifts the piston rod 108 to the top operation limit $H_{OT}$ in up-strokes and gradually lowers the bottom stop position $H_B$ of the piston rod 108 from an initial bottom stop position $H_{B1}$, which is above the bottom operation limit $H_{OB}$ with a distance of $(1-C_1)S_N/2$, to the bottom operation limit $H_{OB}$ via a coarse stroke expansion stage and a fine stroke expansion stage.

At the first re-initialization down-stroke $D_{k+1}$, i.e., the overall (k+1)-th down stroke, the control unit 134 lowers the piston rod 108 to the predefined initial bottom stop position $H_{B1}$. In the successive up-stroke $U_{k+1}$, the control unit 134 lifts the piston rod 108 to the top operation limit $H_{OT}$.

In the next down-stroke $D_{k+2}$, the control unit 134 lowers the piston rod 108 to an expanded bottom stop position $H_{B2}=H_{B1}-\Delta_C$. In the successive up-stroke $U_{k+2}$, the control unit 134 lifts the piston rod 108 to the top operation limit $H_{OT}$.

In this manner, the bottom stop position of the piston rod 108 is expanded for p stroke cycles, wherein the control unit 134 lowers the bottom stop position $H_B$ by a relatively large stroke expansion step value $\Delta_C$ in each down-stroke, and lifts the piston rod to the top operation limit $H_{OT}$ in each up-stroke. The process then enters the fine stroke expansion stage.

At the first down-stroke $D_{k+p+1}$ of the fine stroke expansion stage, i.e., the overall (k+p+1)-th down-stroke, the control unit 134 lowers the bottom stop position to an expanded bottom stop position $H_{B(p+1)}=H_{Bp}+\Delta_F$, where $H_{Bp}$ represents the bottom position of the last down-stroke $D_{k+p}$ in the coarse stroke expansion stage (i.e., overall (k+p)-th down-stroke). The control unit 134 lifts the piston rod 108 to the top operation limit $H_{OT}$ in the successive up-stroke $U_{k+p+1}$.

In this manner, the bottom stop position of the piston rod 108 is expanded for q stroke cycles, wherein the control unit 134 lifts the piston rod to the top operation limit $H_{OT}$ in each up-stroke, and lowers the bottom stop position $H_B$ by a relatively small stroke expansion step value $\Delta_F$ in each down-stroke, to expand the bottom stop position of the piston rod 108 to the bottom operation limit $H_{OB}$. The re-initialization process is then completed, and the control unit 134 controls the piston rod 108 into the normal operation, reciprocating up and down between the top and bottom operation limits $H_{OT}$ and $H_{OB}$.

Figure 11:
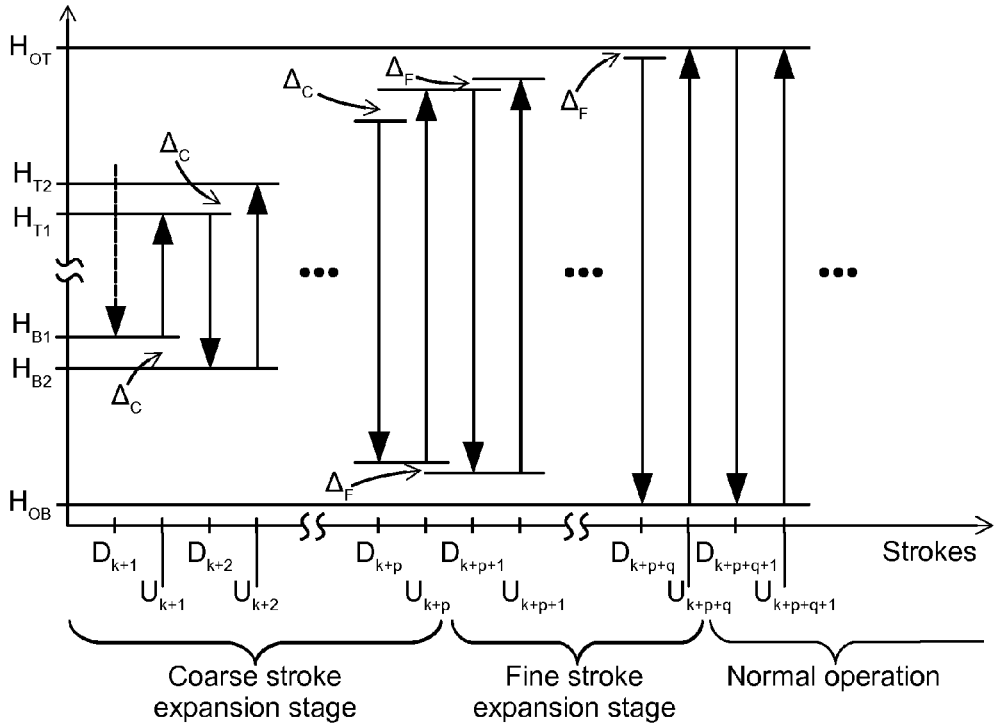
FIG. 11 shows an example of the re-initialization process when, after k stroke cycles, both the up-stroke speed $V_U$ and the down-stroke speed $V_D$ are changed by a user.

FIG. 11 shows an example of the re-initialization process when, after k stroke cycles, both the up-stroke speed $V_U$ and the down-stroke speed $V_D$ are changed by a user.

In this example, the control unit 134 starts the re-initialization process by operating the piston rod 108 between an initial top stop position $H_{T1}$, which is below the top operation limit $H_{OT}$ with a distance of $(1-C_1)S_N/2$, and initial bottom stop position $H_{B1}$, which is above the bottom operation limit $H_{OB}$ with a distance of $(1-C_1)S_N/2$. The control unit 134 then gradually expands the top and bottom stop positions $H_T$ and $H_B$, respectively, to the top and bottom operation limits $H_{OT}$ and $H_{OB}$, via a coarse stroke expansion stage and a fine stroke expansion stage.

At the first re-initialization down-stroke $D_{k+1}$, i.e., the overall (k+1)-th down stroke, the control unit 134 lowers the piston rod 108 to the predefined initial bottom stop position $H_{B1}$. In the successive up-stroke $U_{k+1}$, the control unit 134 lifts the piston rod 108 to the predefined initial top stop position $H_{T1}$.

In the next down-stroke $D_{k+2}$, the control unit 134 lowers the piston rod 108 to an expanded bottom stop position $H_{B2}=H_{B1}-\Delta_C$. In the successive up-stroke $U_{k+2}$, the control unit 134 lifts the piston rod 108 to an expanded top stop position $H_{T2}=H_{T1}+\Delta_C$.

In this manner, the top and bottom stop positions of the piston rod 108 are expanded for p stroke cycles, wherein the control unit 134 lowers the bottom stop position $H_B$ by a relatively large stroke expansion step value $\Delta_C$ in each down-stroke, and raises the top stop position $H_T$ by $\Delta_C$ in each up-stroke. The process then enters the fine stroke expansion stage.

At the first down-stroke $D_{k+p+1}$ of the fine stroke expansion stage, i.e., the overall (k+p+1)-th down-stroke, the control unit 134 lowers the bottom stop position to an expanded bottom stop position $H_{B(p+1)}=H_{Bp}+\Delta_F$, where $H_{Bp}$ represents the bottom position of the last down-stroke $D_{k+p}$ in the coarse stroke expansion stage (i.e., overall (k+p)-th down-stroke). The control unit 134 lifts the piston rod 108 to an expanded top stop position $H_{T(p+1)}=H_{Tp}+\Delta_F$ in the successive up-stroke $U_{k+p+1}$, where $H_{Tp}$ represents the stop position of the last up-stroke $U_{k+p}$ in the coarse stroke expansion stage (i.e., overall (k+p)-th up-stroke).

In this manner, the top and bottom stop positions of the piston rod 108 are expanded for q stroke cycles, wherein the control unit 134 lowers the bottom stop position $H_B$ by a relatively small stroke expansion step value $\Delta_F$ in each down-stroke, and raises the top stop position $H_T$ by $\Delta_F$ in each up-stroke, to expand the top and bottom stop positions of the piston rod 108, respectively, to the top and bottom operation limits $H_{OT}$ and $H_{OB}$. The re-initialization process is then completed, and the control unit 134 controls the piston rod 108 into the normal operation, reciprocating up and down between the top and bottom operation limits $H_{OT}$ and $H_{OB}$.

Figure 12:
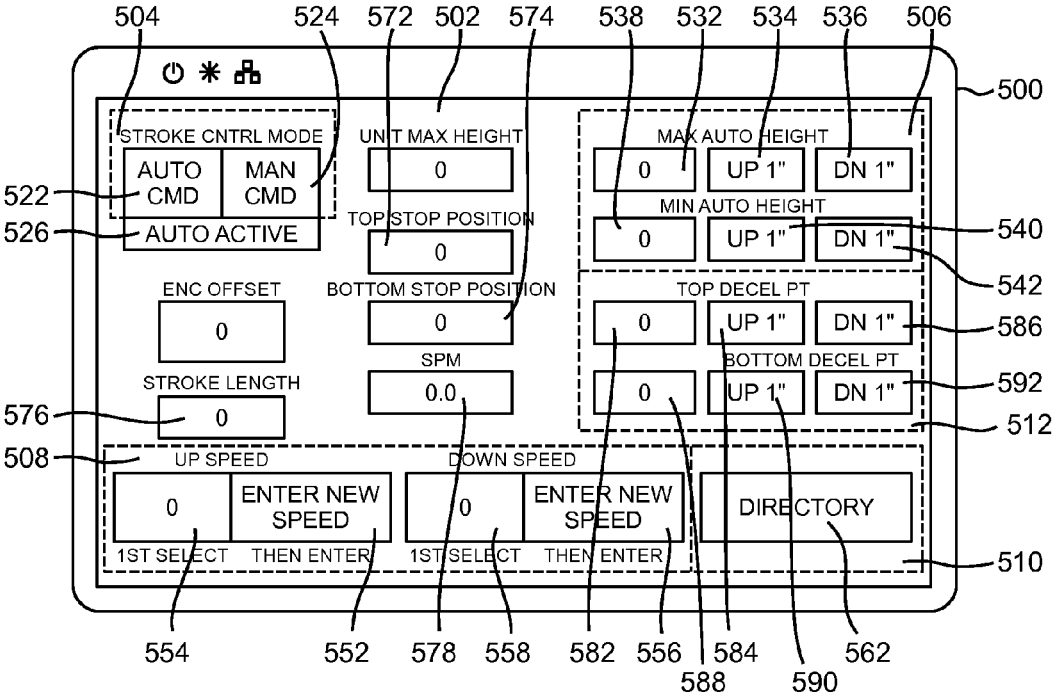
FIG. 12 shows an example of a GUI displayed on the touch-sensitive screen for users to select between the automatic adjusting mode and the manual adjusting mode, and to input system parameters.

FIG. 12 shows an example of a GUI 502 displayed on the touch-sensitive screen 500 for users to select between the automatic adjusting mode and the manual adjusting mode, and to input system parameters. The GUI 502 comprises five (5) input zones, including a stroke control mode selection zone 504 for selecting the automatic adjusting mode or the manual adjusting mode, an auto height input zone 506 for inputting the top and bottom operation limits, a speed input zone 508 for inputting the up-stroke and down-stroke speeds, a directory selection zone 510 for displaying a list of functions provided by the control unit 134, and a manual adjustment zone 512 for manually adjusting the top and bottom deceleration positions $P_{DT}$ and $P_{DB}$. The stroke control mode selection zone 504 and the auto height input zone 506 are only accessible by special users such as an administrator.

To enter the automatic adjusting mode, an administrator first touches the AUTO CMD button 522 in the stroke control mode selection zone 504. Text "AUTO ACTIVE" is then displayed in the mode display field 526 indicating that the automatic adjusting mode is activated. The system 100 then enters the jog mode to facilitate the administrator to determine the top and bottom operation limits $H_{OT}$ and $H_{OB}$. The administrator then touches the button 532 to enter the top operation limit $H_{OT}$.

Figure 13:
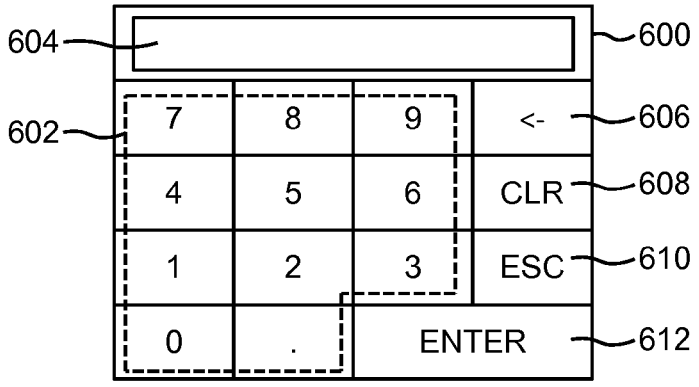
FIG. 13 shows an example of a GUI displayed on the touch-sensitive screen for entering a value.

When the administrator touches the button 532, a GUI pops up on the touch-sensitive screen for the administrator to input a value. FIG. 13 shows an example of a value-input GUI 600. As shown, the GUI 600 comprises a numerical zone 602 having buttons for inputting digits 0-9 and the digital point ".". The entered value is displayed in the display field 604. The GUI 600 also comprises a backspace button 606 for deleting an entered digit, and a CLR button 608 for clearing the entered value. The administrator may touch the ESC button 610 to cancel the value input, or touch the ENTER button 612 to accept the entered value.

Referring back to FIG. 12, the administrator may also touch the button 534, each time increasing the top operation limit $H_{OT}$ by one (1) inch, or touch the button 536, each time decreasing the top operation limit $H_{OT}$ by one (1) inch.

Similarly, the administrator may touch the button 538 to enter the bottom operation limit $H_{OB}$. GUI 600 of FIG. 13 is then popped up for user to enter a value as the bottom operation limit $H_{OB}$. The administrator may also touch the button 540, each time increasing the bottom operation limit $H_{OB}$ by one (1) inch, or touch the button 542, each time decreasing the bottom operation limit $H_{OB}$ by one (1) inch.

The control unit 134 checks the user-entered values of $H_{OT}$ and $H_{OB}$, and rejects invalid value(s), such as a value entered for the top operation limit $H_{OT}$ that is larger than the top safety limit $H_{ST}$ or smaller than the value entered for the bottom operation limit $H_{OB}$, and remind the user to correct the error.

The user may also touch the button 552 in the speed input zone 508 to enter an up-stroke speed. As in this embodiment, the system 100 provides seven (7) speed levels each corresponding to a predefined up-stroke speed, the user may enter an integer number between 1 and 7 to select an up-stroke speed $V_U$. The entered speed level is displayed in the up-stroke speed level display field 554.

Similarly, the user may touch the button 556 in the speed input zone 508 to enter a down-stroke speed. As in this embodiment, the system 100 provides seven (7) speed levels each corresponding to a predefined down-stroke speed, the user may enter an integer number between 1 and 7 to select a down-stroke speed $V_D$. The entered speed level is displayed in the down-stroke speed level display field 558.

After the system parameters have been input via the GUI 500, and the system 100 has started, the GUI 500 displays some measured data in real-time, such as the top stop position $H_T$ in field 572, the bottom stop position $H_B$ in field 574, the stroke length S in field 576 and the strokes per minute measurement in field 578.

During system operation, a regular user, e.g., an operator, may use the buttons 552 and 556 in the GUI 500 to adjust the up- and down-stroke speeds $V_U$ and $V_D$. The control unit 134 automatically adjust the system operation as described above, in response to the up- and/or down-stroke speed change.

The manual adjustment zone 512 is disabled when the automatic adjusting mode is activated. However, an administrator may touch the MAN CMD button 524 in the stroke control mode input zone 504 to activate the manual adjusting mode. The mode display field then displays "MANUAL ACTIVE" to indicate that the manual adjusting mode is activated. The manual adjustment zone 512 is enabled, and the auto height input zone 506 is disable.

In the manual adjusting mode, a user, e.g., an administrator or an operator, has to constantly monitor the up- and down-strokes, and use the buttons 582 and 588 to enter a top and a bottom deceleration position $P_{DT}$ and $P_{DB}$. The user may also use the buttons 584 and 590 each time increasing the top and bottom deceleration position $P_{DT}$ and $P_{DB}$, respectively, by one (1) inch, or use the buttons 586 and 592 each time decreasing the top and bottom deceleration position $P_{DT}$ and $P_{DB}$, respectively, by 1 inch.

As described above, for safety reasons, the top safety limit $H_{ST}$ is lower than the physical top limit that the piston rod 108 can be extended thereto, and the bottom safety limit $H_{SB}$ is higher than the physical bottom limit that the piston rod 108 can be lowered thereto. During operation, the control unit 134 operates the piston rod 108 at a user-selected up-stroke speed $V_U$ and a user-selected down-stroke $V_D$, between a user-selected top operation limit $H_{OT}$ lower than the top safety limit $H_{ST}$, i.e., $H_{OT}<H_{ST}$, and a user-selected bottom operation limit $H_{OB}$ higher than the bottom safety limit $H_{SB}$, i.e., $H_{OB}>H_{SB}$.

Although the control unit 134 automatically adjusts the up- and down-strokes if the top and/or bottom stop positions $H_T$ and $H_B$ of the piston rod 108 are drifted from $H_{OT}$ and $H_{OB}$, respectively, such automatic adjustment may fail if the drift is too large. For example, if, during an up-stroke, the load applied to the piston rod is lost because, for example, the cable 114 snaps, or the rod string 122 fails, the upward hydraulic force applied to the piston rod 108 may drive the piston rod 108 to quickly move upward beyond the top safety limit $H_{ST}$, which is commonly denoted as "over-stroke". Serious hazard would occur if the piston rod 108 hit and break through the top wall of the hydraulic cylinder 106. In an alternative embodiment, the system 100 further comprises a safety dump valve that is opened when over-stroke occurs, to prevent the piston rod 108 from hitting the top wall of the hydraulic cylinder 106.

Figure 14:
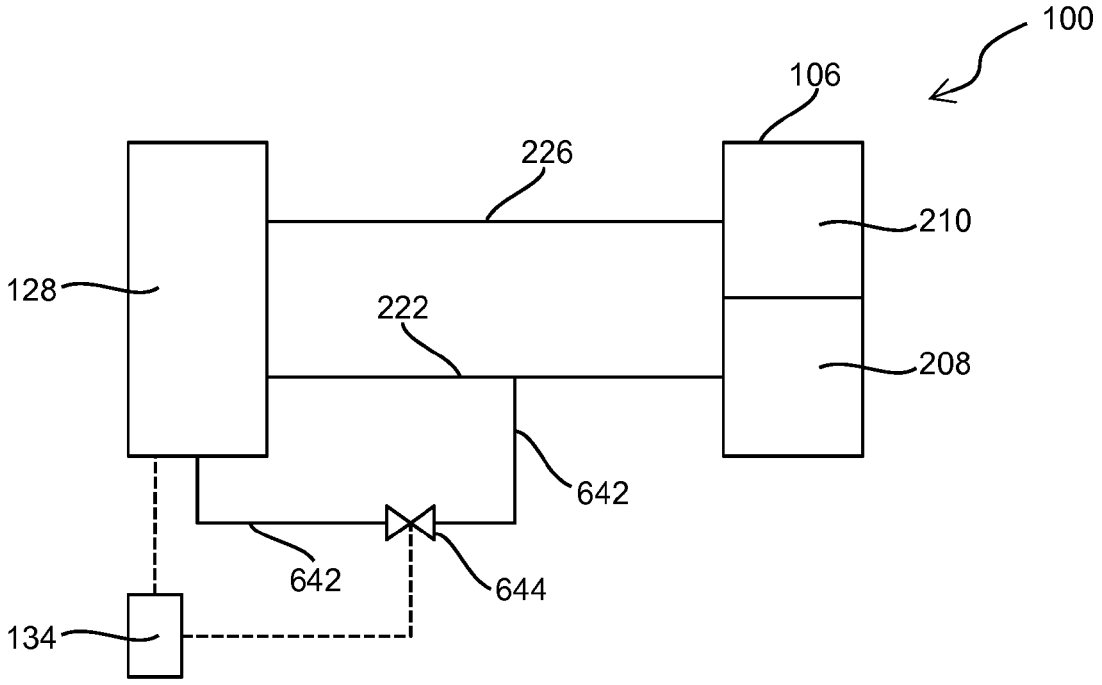
FIG. 14 is a simplified schematic diagram of the hydraulically-actuated rod pump system, according to an alternative embodiment.

FIG. 14 shows a simplified schematic diagram of the hydraulically-actuated rod pump system 100 in this embodiment, indicating the flow of the power fluid. For the ease of illustration, FIG. 14 only shows the hydraulic power unit 128, the hydraulic cylinder 106, and conduits connected therebetween, as well as the control unit 134 and control switches.

As shown, the hydraulic power unit 128 is connected to the down chamber 210 of the hydraulic cylinder 106 via a set of conduits 226, and connected to the up chamber 208 of the hydraulic cylinder 106 via a set of conduits 222. In this embodiment, a conduit 642 branches from the conduit 222, and connects back to the power fluid reservoir of the hydraulic power unit 128 via a normally-closed dump valve 644 such as a normally-closed solenoid valve. The control unit 134 controls the operation of the hydraulic power unit 128, and controls the open and close of the dump valve 644.

Figure 15:
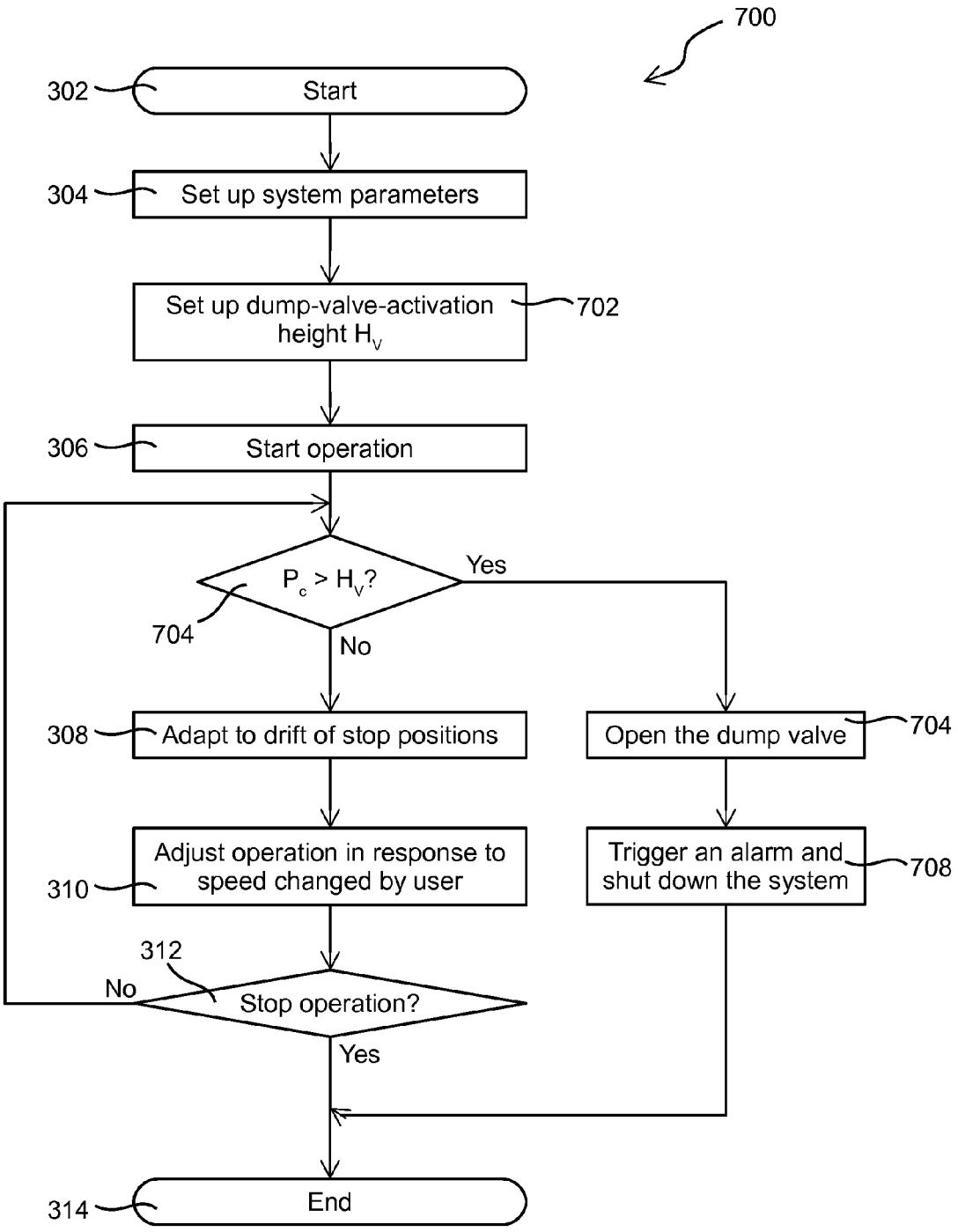
FIG. 15 is a flowchart showing a process of operating the hydraulically-actuated rod pump system of FIG. 14, performed by the control unit.

FIG. 15 is a flowchart showing a process 700 of operating the hydraulically-actuated rod pump system 100 performed by the control unit 134 in this embodiment. The process 700 is similar to process 300 of FIG. 4A with additional steps 702 to 708. The steps same in both processes 300 and 700 are identified using the same numerals, and are not described.

Figure 16:
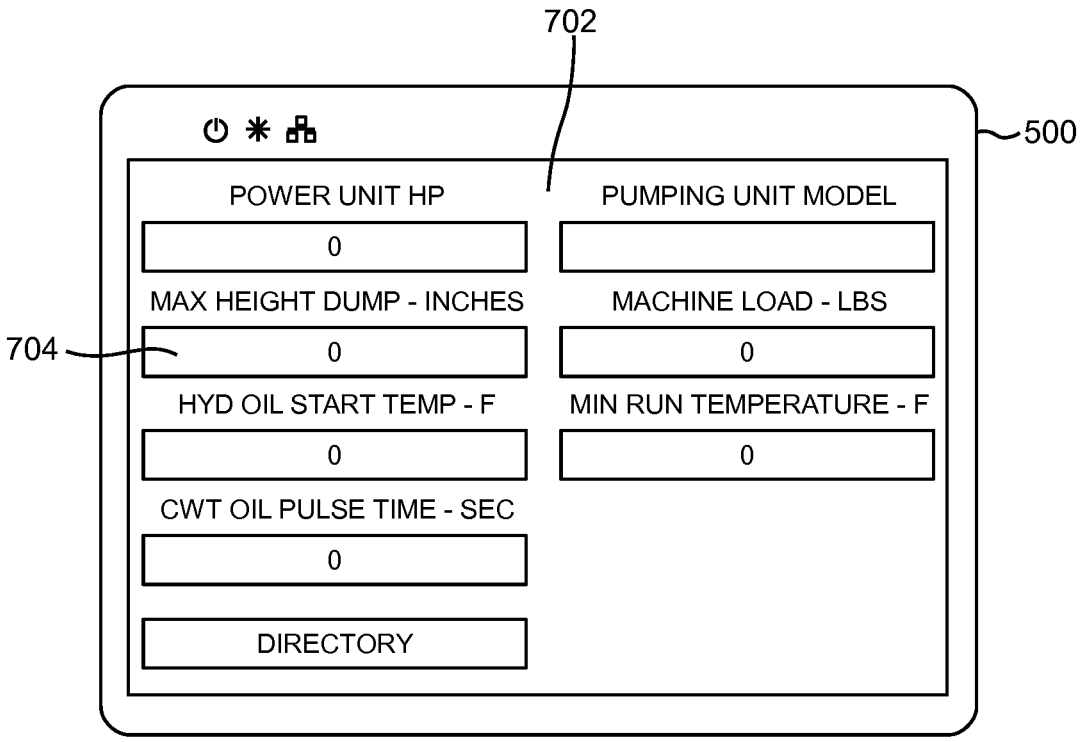
FIG. 16 shows an example of a GUI display on the touch-sensitive screen for an administrator to enter a top-dump-valve-activation height $H_V$.

As shown in FIG. 15, after setting up system parameters (step 304) as described above, the control unit 134 further provides a GUI for an administrator to set up a top-dump-valve-activation height $H_V$, the default value of which is the top safety limit $H_{ST}$ (step 702). FIG. 16 shows an example of a GUI 702 display on the touch-sensitive screen 500. An administrator may touch the field 704 of the GUI 702 to enter a top-dump-valve-activation height $H_V$. The control unit checks if the entered $H_V$ value is valid, e.g., being smaller than the predefined top safety limit $H_{ST}$, and rejects any invalid $H_V$ value.

Referring back to FIG. 15, after setting up the top-dump-valve-activation height $H_V$, the control unit 134 starts the system operation (step 306) as described above. As the dump valve 644 is normally closed, the hydraulic power unit 128, under the command of the control unit 134, alternately pumps power fluid into the up and down chambers 208 and 210 of the hydraulic cylinder 106 to pump downhole fluid to the surface.

The control unit 134 monitors the position of the piston rod 108, and checks whether the position $P_c$ of the piston rod 108 has move upward beyond the top-dump-valve-activation height $H_V$ (step 704). If not, the process goes to step 308 to detect the drift of stop positions and adapt thereto, as described above.

If, however, the control unit 134 detects that the position $P_c$ of the piston rod 108 is above the top-dump-valve-activation height $H_V$, the control unit 134 commands the dump valve 644 to open (step 706). As a result, the power fluid pumped into the conduits 222 flows back into the power fluid reservoir of the hydraulic power unit 128 without entering the up chamber 208 of the hydraulic cylinder 106 to drive the piston rod 108. The hydraulic force driving the piston rod 108 upward is then removed, and the piston rod 108 decelerates and stops by the gravity.

At step 706, the control unit 134 triggers an alarm to warn operators that an emergency event has occurred, and shuts down the system 100 (step 708). The process then terminates (step 314).

Figure 17:
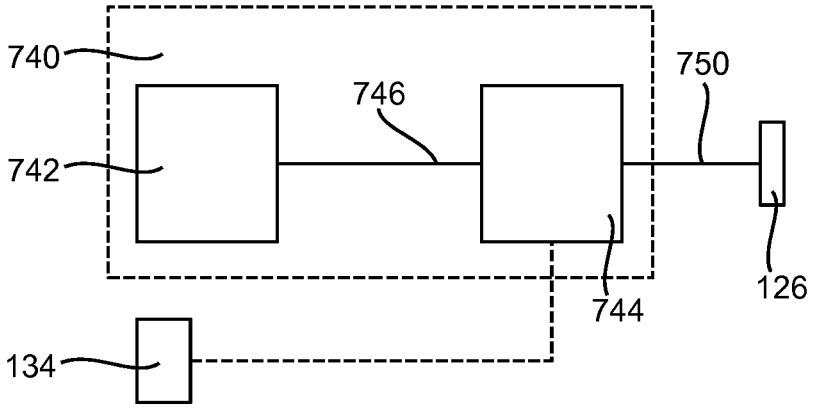
FIG. 17 shows a simplified schematic diagram of a chemical injection unit used in the hydraulically-actuated rod pump system, according to another embodiment.

In an optional embodiment, the hydraulically-actuated rod pump system further comprises a chemical injection unit for injecting suitable treatment fluid into a borehole for treating the downhole production fluid. FIG. 17 shows a simplified schematic diagram of the chemical injection unit 740. As shown, the chemical injection unit 740 comprises a treatment fluid reservoir 742 and a chemical injection assembly 744 interconnected by a set of conduits 746. The chemical injection assembly 744 is connected to the wellhead 126 via a set of conduits 750.

Any suitable chemical injection assembly may be used in this embodiment for injecting treatment fluid into a wellbore, possibly with modification and addition of electrical control such that the operation of the chemical injection assembly may be controlled by the control unit 134. For example, the chemical injection assembly may be a chemical injection assembly as disclosed in U.S. Pat. No. 5,117,913, entitled "Chemical injection system for downhole treating" to Themig, issued on Jun. 2, 1992, the content of which is incorporated herein by reference in its entirety. Such a chemical injection assembly comprises a fixed packer having an opening passing therethrough for receiving a production tubing string, a closable orifice in the packer that is actuated by the tubing string and appropriate seals for preventing fluid transfer within the packer. When the tubing string is inserted into the packer, a collar on the tubing string engages a shiftable sleeve that places an orifice in the shifting sleeve in alignment with the orifice in the injection sleeve so that chemical treatment fluid from the surface can be forced down the bore-hole casing through the closable orifice in the packer and into the production fluid at the perforations near the producing formations.

The operation of the chemical injection assembly 744 is controlled by the control unit 134 in accordance with the system operation. In particular, in one embodiment, the control unit 134 automatically turns on the chemical injection assembly 744 to injection treatment fluid to the wellbore via the wellhead 126 when the system is in operation such as pumping downhole fluid to the surface, and turns off the chemical injection assembly 744 to stop chemical injection when the system is not in operation.

In an alternative embodiment, the chemical injection unit 740 comprises an injection control component (not shown) controlling chemical injection. The injection control component is connected to the control unit 134, and may be enabled or disabled by the control unit 134. In this embodiment, the control unit 134 disables the injection control component to stop chemical injection when the system is not in operation. When the system is in operation, the control unit 134 enables the injection control component, and the injection control component controls the chemical injection. For example, when enabled, the injection control component may automatically start or stop chemical injection based on a set of predefined criteria. An operator may manually turn off the injection control component to stop chemical injection.

In an alternative embodiment, the chemical injection assembly 744 further comprises a normally-off manual control switch (not shown), which turned on by an operator, turns on the chemical injection regardless whether or not the system is in operation.

In another embodiment, the system 100 comprises two or more pressurized gas vessels 136 for weight counterbalancing.

In above embodiments, the coarse and fine extension step values $\Delta_C$ and $\Delta_F$ are predefined, and the control unit 134 calculates the numbers n and m of the stroke cycles required in the coarse and fine initialization/re-initialization stages, respectively, based on $\Delta_C$ and $\Delta_F$. In an alternative embodiment, the stroke cycle numbers n and m may be predefined, and the control unit 134 calculates a suitable $\Delta_C$ and $\Delta_F$ based on n and m, respectively.

In above embodiments, the jacking actuator 102 comprises a three-chamber hydraulic cylinder 106. However, those skilled in the art appreciate that, other types of jacking actuator may be alternatively used. For example, in one embodiment, the jacking actuator 102 comprises a double-acting hydraulic cylinder receiving a piston rod. A first hydraulic chamber is formed in the hydraulic cylinder under the piston rod, and a second hydraulic chamber is formed about the piston rod. The first and second hydraulic chambers are connected to the power fluid reservoir of the hydraulic power unit via a first and a second set of conduits, respectively. A hydraulic motor of the hydraulic power unit pumps power fluid into the first hydraulic chamber to lift the piston rod, and pumps power fluid into the second hydraulic chamber to lower the piston rod.

Those skilled in the art also appreciate that, in some alternatively embodiments, the piston rod may be driven by other power means, e.g., combusting fluid or compressed gas, to reciprocate.

Although in above embodiments, the jacking actuator 102 is vertically oriented, in an alternative embodiment, the jacking actuator is in a tilted orientation. In yet another embodiment, the jacking actuator is horizontally oriented with the cable 114 being aligned with the rod string 122.

Although in above embodiments, the jacking actuator 102 comprises a cylinder 106 and a piston rod 108 received therein for reciprocating the pulley assembly 112, in some other embodiments, the jacking actuator 102 is a linear actuator reciprocating between a first and a second stop positions to drive the pulley assembly 112 and in turn the sucker rod 122 to pump downhole fluid to the surface. A control unit detects the drift of the first and second stop positions and automatically minimize detected drift as described above.

In these embodiments, the power unit may be any suitable drive, such as a variable frequency drive (VFD), a linear motor or the like, that drives the linear actuator reciprocating between the first and second stop positions. Accordingly, the power unit may engage the linear actuator via any suitable mechanical traction means such as cable, chain or the like.

In above initialization and re-initialization processes of FIGS. 5A, 5B, 9 and 10, a stroke cycle starts from a down-stroke followed by an up-stroke, and the first stroke cycle is between the initial top stop position $H_{T1}$ and the initial bottom stop position $H_{B1}$ before the top and/or bottom stop positions are expanded. Those skilled in the art appreciate that, a stroke cycle may alternatively start from an up-stroke followed by a down-stroke. Moreover, in some alternative embodiments, the control unit 134 starts to expand the stop position after the first down- or up-stroke is completed.

Those skilled in the art also appreciate that, in some embodiments, the initialization and/or re-initialization processes may comprise a single stop position expansion stage. In some other embodiments, the initialization and/or re-initialization processes may comprise three or more stop position expansion stages. However, the last stop position expansion stage is preferably a fine expansion stage.

In above embodiments, the control unit 134 adjusts the actual top and bottom stop positions PST and PSB by adjusting the top and bottom deceleration positions, respectively. In an alternative embodiment, the control unit 134 does not adjust the top and bottom deceleration positions. Rather, the control unit 134 maintains a predefined top and a predefined bottom deceleration position, and adjusts the up- and down-stroke deceleration rate to adapt to the drift of the top and bottom stop positions. In particular, if the actual top stop position is higher than the top operation limit $H_{OT}$, the deceleration rate of the next up-stroke is then increased to decelerate the piston rod faster. If the actual top stop position is lower than the top operation limit $H_{OT}$, the deceleration rate of the next up-stroke is then decreased to decelerate the piston rod slower. Similarly, if the actual bottom stop position is higher than the top operation limit $H_{OT}$, the deceleration rate of the next down-stroke is then decreased to decelerate the piston rod slower. If the actual top stop position is lower than the top operation limit $H_{OT}$, the deceleration rate of the next down-stroke is then increased to decelerate the piston rod faster.

In the embodiment of FIG. 1A, the deceleration rate is adjusted by adjusting the pressure of the power fluid in the up and down chambers, as those skilled in the art have known. In embodiments where other types of linear actuators are used, mechanisms for changing the deceleration rate suitable for the respective linear actuators may be used, which is also known to those skilled in the art, and is omitted herein.

In the initialization and re-initialization processes of above embodiments, the control unit 134 calculates n and m based on $\Delta_C$ and $\Delta_F$, respectively. In an alternative embodiment, the control unit 134 does not calculate n and m. Rather, the control unit 134 measures the distance between the top/bottom stop positions and the top/bottom operation limits during the coarse expansion stage, and enters the fine expansion stage when the distance between the top/bottom stop positions and the top/bottom operation limits is smaller than or equal to $\Delta_C$. During the fine expansion stage, the control unit 134 also measures the distance between the top/bottom stop positions and the top/bottom operation limits, and completes the initialization process when the distance between the top/bottom stop positions and the top/bottom operation limits is smaller than $\Delta_F$. The control unit 134 sets the top and bottom stop positions to the top and bottom operation limits, respectively, if $\Delta_F \neq 0$.

In another embodiment, the initialization/re-initialization process only comprises one stage. During the initialization/re-initialization, the control unit 134 expands each stroke by a stroke expansion value $\Delta$ and measures the distance between the top/bottom stop positions and the top/bottom operation limits. When the distance between the top/bottom stop positions and the top/bottom operation limits is smaller than $\Delta$, the control unit 134 sets the top and bottom stop positions to the top and bottom operation limits, respectively.

Although embodiments have been described above with reference to the accompanying drawings, those of skill in the art will appreciate that variations and modifications may be made without departing from the scope thereof as defined by the appended claims.

What is claimed is:

1. A lifting system for lifting downhole fluid from a downhole rod pump in a wellbore to surface, comprising:

a linear actuator comprising a movable component moveable between a first and a second limit and driveably coupled to the downhole rod pump;

a power unit coupled to said linear actuator for driving said movable component to reciprocate; the reciprocating of said movable component driving said downhole rod pump to pump downhole fluid to the surface;

a sensor for detecting the position of said movable component; and a control unit coupled to said sensor and said power unit for controlling the power unit for reciprocating said movable component between a first target stop position and a second target stop position, for moving said movable component uphole to stop at about said first target stop position, and for moving said movable component downhole to stop at about said second target stop position;

determining, based on the position information received from said sensor, a first actual stop position and a second actual stop position;

determining a first drift being the difference between the first actual stop position and the first target stop position, and a second drift being the difference between the second actual stop position and the second target stop position; and automatically controlling the operation of the power unit to minimize the first and second drifts;

wherein said control unit further controls said power unit to initialize the operation of the lifting system through a first initialization stage by:

determining an initial first stop position and an initial second stop position about the mid-point of the target top and bottom stop positions, the distance between the initial first stop position and the initial second stop position is a predefined percentage of the distance between the first and second target stop positions; and moving the movable component to one of the initial first and second stop positions to reciprocate the movable component for at least one reciprocating cycle, wherein in each of the at least one reciprocating cycle, said control unit controls said power unit to expand the initial first and second stop positions toward the first and second target stop positions, respectively, by a first expansion step value.

2. The lifting system of claim 1, wherein during said first initialization stage, said control unit controls said power unit to reciprocate the movable component until the distance between the initial first and second stop positions and the first and second target stop positions, respectively, is smaller than said first expansion step value.

3. The lifting system of claim 1, wherein said control unit further controls said power unit to initialize the operation of the lifting system through a second initialization stage by:

reciprocating the movable component for at least one reciprocating cycle, wherein in each of said at least one reciprocating cycle in the second initialization stage, said control unit controls said power unit to expand the initial first and second stop positions toward the first and second target stop positions, respectively, by a second expansion step value.

4. The lifting system of claim 3, wherein said first and second expansion step values are predefined values.

5. The lifting system of claim 3, wherein during said second initialization stage, said control unit controls said power unit to reciprocate the movable component until the distance between the first and second actual stop positions and the first and second target stop positions, respectively, is smaller than said second expansion step value.

6. The lifting system of claim 1, further comprising:

a chemical injection assembly coupled to said control unit and the wellbore;

wherein said control unit enables said chemical injection assembly when said lifting system is in operation, and disables said chemical injection assembly when the operation of said lifting system is stopped.

7. The lifting system of claim 1, wherein said control unit stores a predefined first deceleration position at which deceleration of the said movable component commences during the movement thereof towards said first target stop position, and stores a predefined second deceleration position at which deceleration of said movable component is commenced during the movement thereof towards said second target stop position; and wherein said automatically adjusting the operation of the power unit comprises:

adjusting the position of the predefined first deceleration position based on the first drift;

adjusting the position of the predefined second deceleration position based on the second drift; and adjusting the operation of the power unit to decelerate said movable component at the adjusted first deceleration position during the movement thereof towards said first target stop position, and to decelerate said movable component at the adjusted second deceleration position during the movement thereof towards said second target stop position.

8. The lifting system of claim 7, wherein said adjusted first deceleration position is the difference between said predefined first deceleration position and said first drift, and said adjusted second deceleration position is the difference between said predefined second deceleration position and said second drift.

9. The lifting system of claim 1, wherein said linear actuator comprises:

a hollow cylinder receiving a piston rod axially movable therein; and at least a first chamber for receiving a power medium; the intake of the power medium into said first chamber driving said piston rod moving towards the first target stop position.

10. The lifting system of claim 9, wherein said power medium is a power fluid; and wherein said power unit is a hydraulic power unit comprising a hydraulic motor and a power fluid reservoir storing said power fluid, said hydraulic motor sending said power fluid, via a set of conduits, into and out of said first chamber for driving said piston rod to reciprocate in said cylinder.

11. The lifting system of claim 10, wherein said a set of conduits comprises a conduit branch connected to said power fluid reservoir via a normally-closed valve, and said control unit is further controllably coupled to said valve for determining whether the position of said piston rod, during the movement towards said first target stop position, is beyond a first limit, said first limit is further from said first target stop position along the direction of said movement towards said first target stop position; and opening said valve for flowing the power fluid in said a set of conduits into said power fluid reservoir via said conduit branch and said valve.

12. A method for lifting downhole fluid from a reciprocating downhole fluid lifting device to surface, comprising:

setting up a first and a second target stop position;

reciprocating a movable component of a linear actuator between said first and second target stop positions for driving the downhole fluid lifting device;

determining a first actual stop position corresponding to said first target stop position and a second actual stop position corresponding to said second target stop position;

determining a first drift being the difference between the first actual stop position and the first target stop position, and a second drift being the difference between the second actual stop position and the second target stop position; and automatically adjusting the reciprocating of the movable component to minimize for the first and second drifts;

wherein the method further comprises an initialization process, comprising:

determining an initial first stop position and an initial second stop position about the mid-point of the target top and bottom stop positions, the distance between the initial first stop position and the initial second stop position is a predefined percentage of the distance between the first and second target stop positions;

moving the movable component to one of the initial first and second stop positions to reciprocate the movable component for n reciprocating cycle(s), wherein $n \geq 1$, and in each of the n reciprocating cycle(s), said control unit controls said power unit to expand the initial first and second stop positions toward the first and second target stop positions, respectively, by the first expansion step value; and when the distance between the first and second stop positions and the first and second target stop positions, respectively, is smaller than said first expansion step value, reciprocating the movable component for m reciprocating cycle(s), wherein $m \geq 1$, and in each of the m reciprocating cycle(s), said control unit controls said power unit to expand the initial first and second stop positions toward the first and second target stop positions, respectively, by a second expansion step value.

13. The method of claim 12, wherein said automatically adjusting the reciprocating of the movable component comprises:

determining a first deceleration position based on the first drift;

determining a second deceleration position based on the second drift; and decelerating said movable component at the first deceleration position during the movement thereof towards said first target stop position, and decelerating said movable component at the second deceleration position during the movement thereof towards said second target stop position.

14. The method of claim 13, wherein said determining a first deceleration position comprises:

calculating the first deceleration position as the difference between a predefined first deceleration position and said first drift; and calculating the second deceleration position as the difference between a predefined second deceleration position and said second drift.

15. The method of claim 12, wherein said reciprocating a movable component of a linear actuator comprises:

sending a power fluid into a chamber coupled to said movable component to move the movable component towards the first target stop position.

16. The method of claim 15, wherein said reciprocating a movable component of a linear actuator further comprises:

determining whether the position of said movable component, during the movement towards said first target stop position, is beyond a first limit, said first limit being further from said first target stop position along the direction of said movement towards said first target stop position; and preventing the power fluid from entering into said chamber.

17. A lifting system for lifting downhole fluid from a downhole rod pump in a wellbore to surface, comprising:

a linear actuator comprising a movable component moveable between a first and a second limit and driveably coupled to the downhole rod pump;

a power unit coupled to said linear actuator for driving said movable component to reciprocate; the reciprocating of said movable component driving said downhole rod pump to pump downhole fluid to the surface;

a sensor for detecting the position of said movable component; and a control unit coupled to said sensor and said power unit for:

controlling the power unit for reciprocating said movable component between a first target stop position and a second target stop position, for moving said movable component uphole to stop at about said first target stop position, and for moving said movable component downhole to stop at about said second target stop position;

determining, based on the position information received from said sensor, a first actual stop position and a second actual stop position;

determining a first drift being the difference between the first actual stop position and the first target stop position, and a second drift being the difference between the second actual stop position and the second target stop position; and automatically controlling the operation of the power unit to minimize the first and second drifts;

wherein said control unit controls said power unit to move the movable component towards the first target stop position at a first speed and to move the movable component towards the second target stop position at a second speed; and wherein said control unit receives a command from an operator indicating a change of at least one of the first and the second speeds, and in response to said command, initializes the operation of the lifting system by:

determining an initial first stop position if the first speed is changed, said initial first stop position being intermediate to the first and second target stop positions with a distance to the first target stop position of $(1-C_1)S_N/2$, wherein $S_N$ is the distance between the first and second target stop positions and $C_1$ is a predefined percentage;

determining an initial second stop position if the second speed is changed, said initial second stop position being intermediate to the first and second target stop positions with a distance to the second target stop position of $(1-C_1)S_N/2$;

determining at least a first expansion step value;

determining at least a first number p of reciprocating cycles corresponding to said first expansion step value; and reciprocating the movable component for p reciprocating cycles, wherein in the first cycle of the p reciprocating cycles, said control unit controls said power unit to:

move the movable component to the initial first stop position if the first speed is changed;

move the movable component to the initial second stop position if the second speed is changed; and in the next (p−1) reciprocating cycles, said control unit controls said power unit to:

expand the initial first stop position toward the first target stop position by the first expansion step value if the first speed is changed; and expand the initial second stop position toward the second target stop position by the first expansion step value if the second speed is changed.

18. The lifting system of claim 17, wherein said control unit controls said power unit to reciprocate the movable component until the distance between the initial first and second stop positions and the first and second target stop positions, respectively, is smaller than said first expansion step value.

19. The lifting system of claim 17, further comprising:

a chemical injection assembly coupled to said control unit and the wellbore; wherein said control unit enables said chemical injection assembly when said lifting system is in operation, and disables said chemical injection assembly when the operation of said lifting system is stopped.

20. The lifting system of claim 17, wherein said control unit m initializes the operation of the lifting system by further:

determining a second expansion step value;

determining a second number q of reciprocating cycles corresponding to said second expansion step value; and after said p reciprocating cycles are completed, reciprocating the movable component for q reciprocating cycles, wherein in each of the q reciprocating cycles, said control unit controls said power unit to expand the initial first stop position toward the first target stop position by the first expansion step value if the first speed is changed; and expand the initial second stop position toward the second target stop position by the first expansion step value if the second speed is changed.

21. The lifting system of claim 17, wherein said control unit further controls said power unit to initialize the operation of the lifting system through a second initialization stage by:

reciprocating the movable component for at least one reciprocating cycle, wherein in each of said at least one reciprocating cycle in the second initialization stage, said control unit controls said power unit to expand the initial first and second stop positions toward the first and second target stop positions, respectively, by a second expansion step value.

22. The lifting system of claim 21, wherein said first and second expansion step values are predefined values.

23. The lifting system of claim 21, wherein during said second initialization stage, said control unit controls said power unit to reciprocate the movable component until the distance between the first and second actual stop positions and the first and second target stop positions, respectively, is smaller than said second expansion step value.

24. The lifting system of claim 17, wherein said linear actuator comprises:

a hollow cylinder receiving a piston rod axially movable therein; and at least a first chamber for receiving a power medium, the intake of the power medium into said first chamber driving said piston rod moving towards the first target stop position.

25. The lifting system of claim 24, wherein said power medium is a power fluid; and wherein said power unit is a hydraulic power unit comprising a hydraulic motor and a power fluid reservoir storing said power fluid, said hydraulic motor sending said power fluid, via a set of conduits, into and out of said first chamber for driving said piston rod to reciprocate in said cylinder.

26. The lifting system of claim 25, wherein said a set of conduits comprises a conduit branch connected to said power fluid reservoir via a normally-closed valve, and said control unit is further controllably coupled to said valve for determining whether the position of said piston rod, during the movement towards said first target stop position, is beyond a first limit, said first limit is further from said first target stop position along the direction of said movement towards said first target stop position; and opening said valve for flowing the power fluid in said a set of conduits into said power fluid reservoir via said conduit branch and said valve.

27. The lifting system of claim 17, wherein said control unit stores a predefined first deceleration position at which deceleration of the said movable component commences during the movement thereof towards said first target stop position, and stores a predefined second deceleration position at which deceleration of said movable component is commenced during the movement thereof towards said second target stop position; and wherein said automatically controlling the operation of the power unit comprises:

adjusting the position of the predefined first deceleration position based on the first drift;

adjusting the position of the predefined second deceleration position based on the second drift; and adjusting the operation of the power unit to decelerate said movable component at the adjusted first deceleration position during the movement thereof towards said first target stop position, and to decelerate said movable component at the adjusted second deceleration position during the movement thereof towards said second target stop position.

28. The lifting system of claim 27, wherein said adjusted first deceleration position is the difference between said predefined first deceleration position and said first drift, and said adjusted second deceleration position is the difference between said predefined second deceleration position and said second drift.

* * * * *